US010324405B2

(12) United States Patent
Yamaura et al.

(10) Patent No.: US 10,324,405 B2
(45) Date of Patent: Jun. 18, 2019

(54) TRANSFER DEVICE AND IMAGE FORMING APPARATUS

(71) Applicant: FUJI XEROX CO., LTD., Tokyo (JP)

(72) Inventors: Masaaki Yamaura, Kanagawa (JP); Satoshi Shigezaki, Kanagawa (JP); Yoshiki Shimodaira, Kanagawa (JP); Toshiaki Baba, Kanagawa (JP)

(73) Assignee: FUJI XEROX CO., LTD., Tokyo (JP)

( * ) Notice: Subject to any disclaimer, the term of this patent is extended or adjusted under 35 U.S.C. 154(b) by 0 days.

(21) Appl. No.: 15/798,407

(22) Filed: Oct. 31, 2017

(65) Prior Publication Data

US 2018/0364629 A1 Dec. 20, 2018

(30) Foreign Application Priority Data

Jun. 15, 2017 (JP) ..... 2017-118000

(51) Int. Cl.
*G03G 15/00* (2006.01)
*G03G 15/16* (2006.01)

(52) U.S. Cl.
CPC ..... *G03G 15/5054* (2013.01); *G03G 15/1615* (2013.01); *G03G 15/167* (2013.01)

(58) Field of Classification Search
CPC ..... G03G 15/5054; G03G 15/1615
See application file for complete search history.

(56) References Cited

U.S. PATENT DOCUMENTS

2005/0025535 A1* 2/2005 Koichi ..... G03G 15/167 399/313
2005/0196694 A1* 9/2005 Yuasa ..... G03G 9/0804 430/108.4
2008/0176159 A1* 7/2008 Matsumoto ..... G03G 9/0804 430/109.4
2015/0277252 A1* 10/2015 Takahashi ..... G03G 9/0823 430/109.1

FOREIGN PATENT DOCUMENTS

JP 2005-316320 11/2005
JP 2015-219341 12/2015
JP 2016-109753 6/2016

* cited by examiner

*Primary Examiner* — Ryan D Walsh
(74) *Attorney, Agent, or Firm* — JCIPRNET

(57) ABSTRACT

A transfer device includes a holding body that holds a toner image; a transfer body that presses a recording medium against the holding body with a first pressing force or a second pressing force, which is smaller than the first pressing force, to transfer the toner image to the recording medium while transporting the recording medium between the transfer body and the holding body; and a setting portion that sets a pressing force exerted on the recording medium at the second pressing force when a mass of a toner of an uppermost toner layer constituting the toner image and disposed on the holding body is equal to or exceeds a threshold.

7 Claims, 26 Drawing Sheets

FIG. 12A

| | W | K | Y, M, C |
|---|---|---|---|
| AMOUNT OF DEPRESSION | −0.5 mm | 0.3 mm | 0.3 mm |
| EVALUATION RESULT: ORDINARY PAPER SHEET | FAIR | FAIR | FAIR |
| EVALUATION RESULT: THICK PAPER SHEET | FAIR | FAIR | FAIR |

FIG. 12B

| | W | K | Y, M, C |
|---|---|---|---|
| AMOUNT OF DEPRESSION | 0.3 mm | 0.3 mm | 0.3 mm |
| EVALUATION RESULT: ORDINARY PAPER SHEET | FAIR | FAIR | FAIR |
| EVALUATION RESULT: THICK PAPER SHEET | POOR | FAIR | FAIR |

TRANSFER DEVICE AND IMAGE FORMING APPARATUS

CROSS-REFERENCE TO RELATED APPLICATIONS

This application is based on and claims priority under 35 USC 119 from Japanese Patent Application No. 2017-118000 filed Jun. 15, 2017.

BACKGROUND

Technical Field

The present invention relates to a transfer device and an image forming apparatus.

SUMMARY

A transfer device according to an aspect of the invention includes a holding body that holds a toner image, a transfer body that presses a recording medium against the holding body with a first pressing force or a second pressing force, which is smaller than the first pressing force, to transfer the toner image to the recording medium while transporting the recording medium between the transfer body and the holding body, and a setting portion that sets a pressing force exerted on the recording medium at the second pressing force when a mass of a toner of an uppermost toner layer constituting the toner image and disposed on the holding body is equal to or exceeds a threshold.

BRIEF DESCRIPTION OF THE DRAWINGS

Exemplary embodiments of the present invention will be described in detail based on the following figures, wherein:

FIGS. 12A and 12B are tables showing the evaluation results relating to the image forming apparatus according to the first exemplary embodiment of the present invention and the evaluation results relating to an image forming apparatus according to a comparative example;

DETAILED DESCRIPTION

First Exemplary Embodiment

Examples of a transfer device and an image forming apparatus according to a first exemplary embodiment of the present invention are described with reference to FIGS. 1A to 19B. The arrow H shown in these drawings denotes the vertical direction and an apparatus height direction, the arrow W denotes the horizontal direction and an apparatus width direction, and the arrow D denotes the horizontal direction and an apparatus depth direction.

Entire Structure

Figure 5:
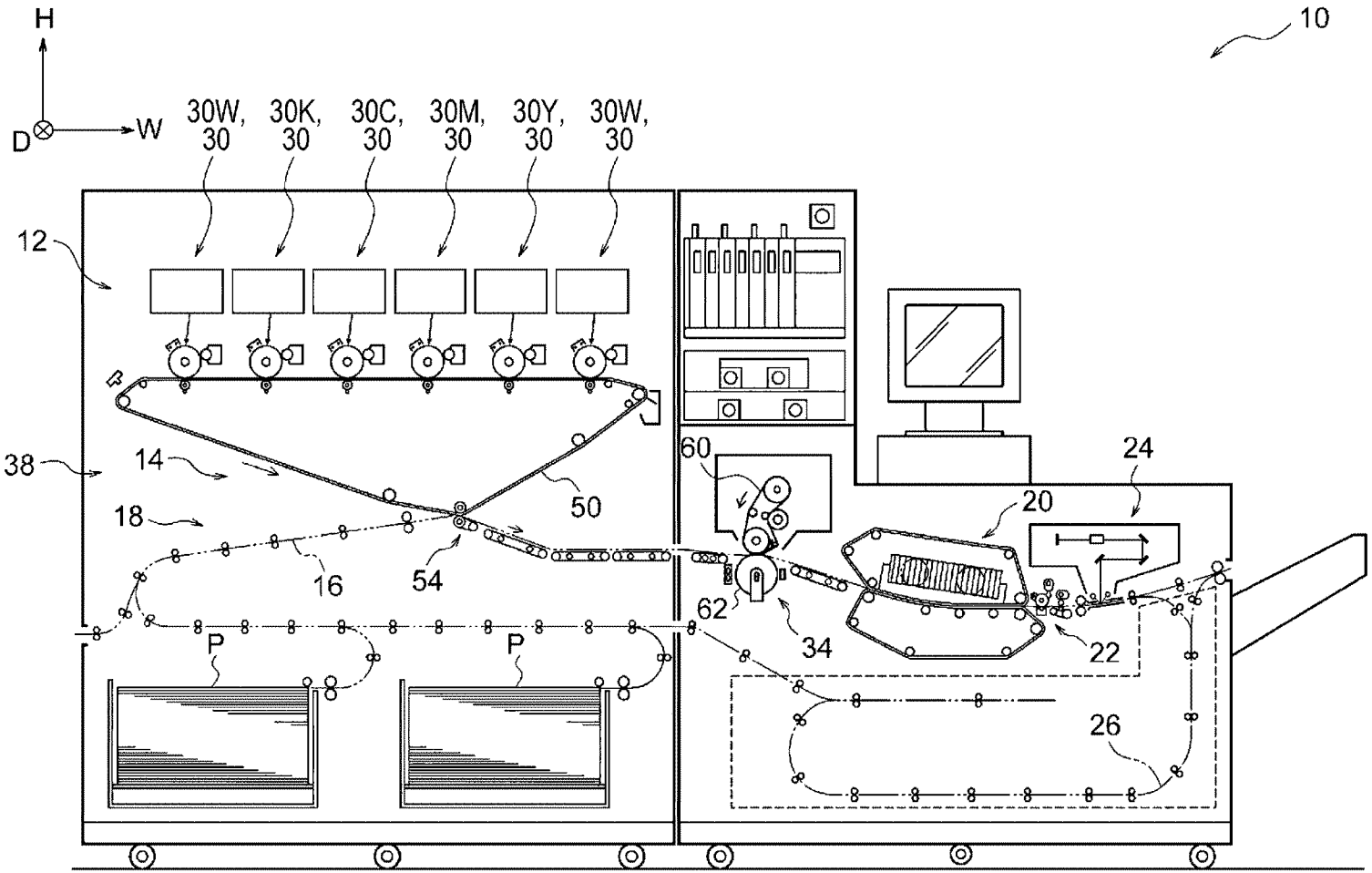
FIG. 5 is a schematic diagram of a structure of the image forming apparatus according to the first exemplary embodiment of the present invention.

As illustrated in FIG. 5, an image forming apparatus 10 includes an image forming unit 12, which forms images by electrophotography, and a transport device 18, which includes multiple transport rollers (not denoted with reference signs) that transport sheet members P (an example of recording media) along a transport path 16 of the sheet members P.

The image forming apparatus 10 includes a cooling portion 20, which cools a sheet member P on which an image is formed, a correcting portion 22, which corrects bending of a sheet member P, and an image inspecting portion 24, which inspects an image formed on a sheet member P.

The image forming apparatus 10 also includes a reverse path 26, which reverses a sheet member P having an image formed on its top surface and transports the sheet member P again toward the image forming unit 12 to form images on both surfaces of the sheet member P.

The image forming apparatus 10 having the above structure forms an image (toner image) formed by the image forming unit 12, on the top surface of a sheet member P transported along the transport path 16. The sheet member P having an image formed thereon passes through the cooling portion 20, the correcting portion 22, and the image inspecting portion 24 in this order and is discharged to the outside of the apparatus.

When an image is to be formed on the back surface of a sheet member P, a sheet member P having an image formed on its top surface is transported along the reverse path 26 and the image forming unit 12 forms an image again on the back surface of the sheet member P.

Image Forming Unit

The image forming unit 12 includes multiple toner layer forming portions 30, which respectively form toner layers of various colors, a transfer belt 50, which holds a toner image formed of one or more toner layers, and a transfer portion 14, which transfers the toner image to a sheet member P. The image forming unit 12 also includes a setting portion 58 (see FIG. 1A), which sets a pressing force exerted to press the sheet member P against the transfer belt 50, and a fixing device 34, which fixes a toner image transferred to a sheet member P by the transfer portion 14 onto the sheet member P.

The multiple toner layer forming portions 30 form toner layers of different colors. In the present exemplary embodiment, the toner layer forming portions 30 are prepared for five colors of yellow (Y), magenta (M), cyan (C), black (K), and white (W). Reference characters Y, M, C, K, and W appended to the reference numerals in FIG. 5 represent the above colors. In the present exemplary embodiment, yellow (Y), magenta (M), cyan (C), and black (K) are basic colors to output a color image. Two toner layer forming portions 30 are prepared for white (W).

In the following description, the characters Y, M, C, K, and W appended to the reference numerals are omitted unless yellow (Y), magenta (M), cyan (C), black (K), and white (W) need to be distinguished from each other. Hereinbelow, yellow (Y), magenta (M), cyan (C), and black (K) may be collectively referred to as "non-white colors".

Figure 3:
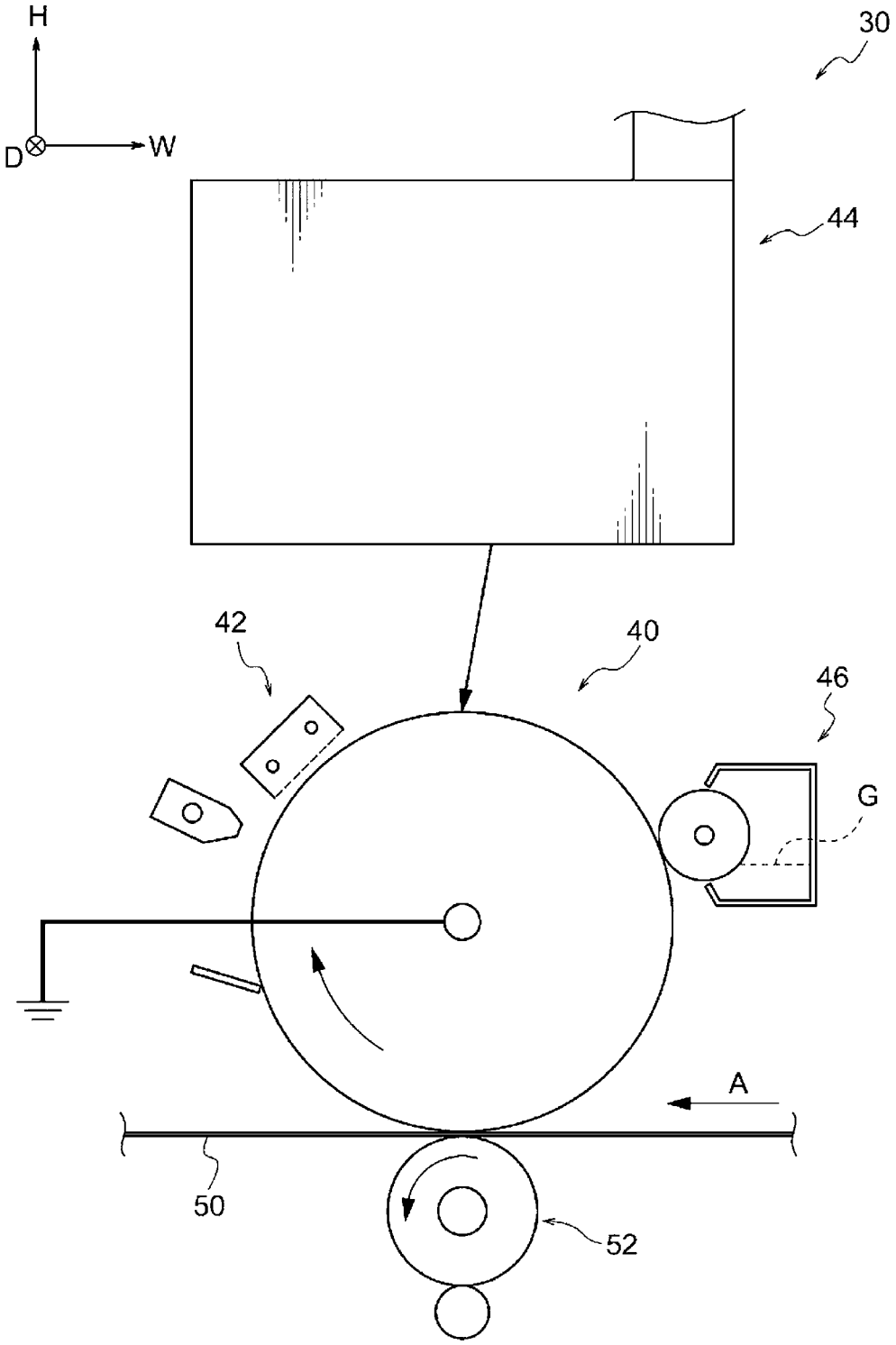
FIG. 3 is a diagram of a structure of a toner layer forming portion of the image forming apparatus according to the first exemplary embodiment of the present invention.

The toner layer forming portions 30 for various colors basically have the same structure except for using different color toners. As illustrated in FIG. 3, each toner layer forming portion 30 includes a rotating cylindrical image carrier 40, and a charging device 42, which charges the image carrier 40. Each toner layer forming portion 30 also includes an exposure device 44, which irradiates the charged image carrier 40 with exposure light to form an electrostatic latent image on the image carrier 40, and a developing device 46, which develops an electrostatic latent image with a developer G containing toner into a toner layer. Here, the developer G used in the present exemplary embodiment is a binary developer containing a toner and a carrier.

Figure 4:
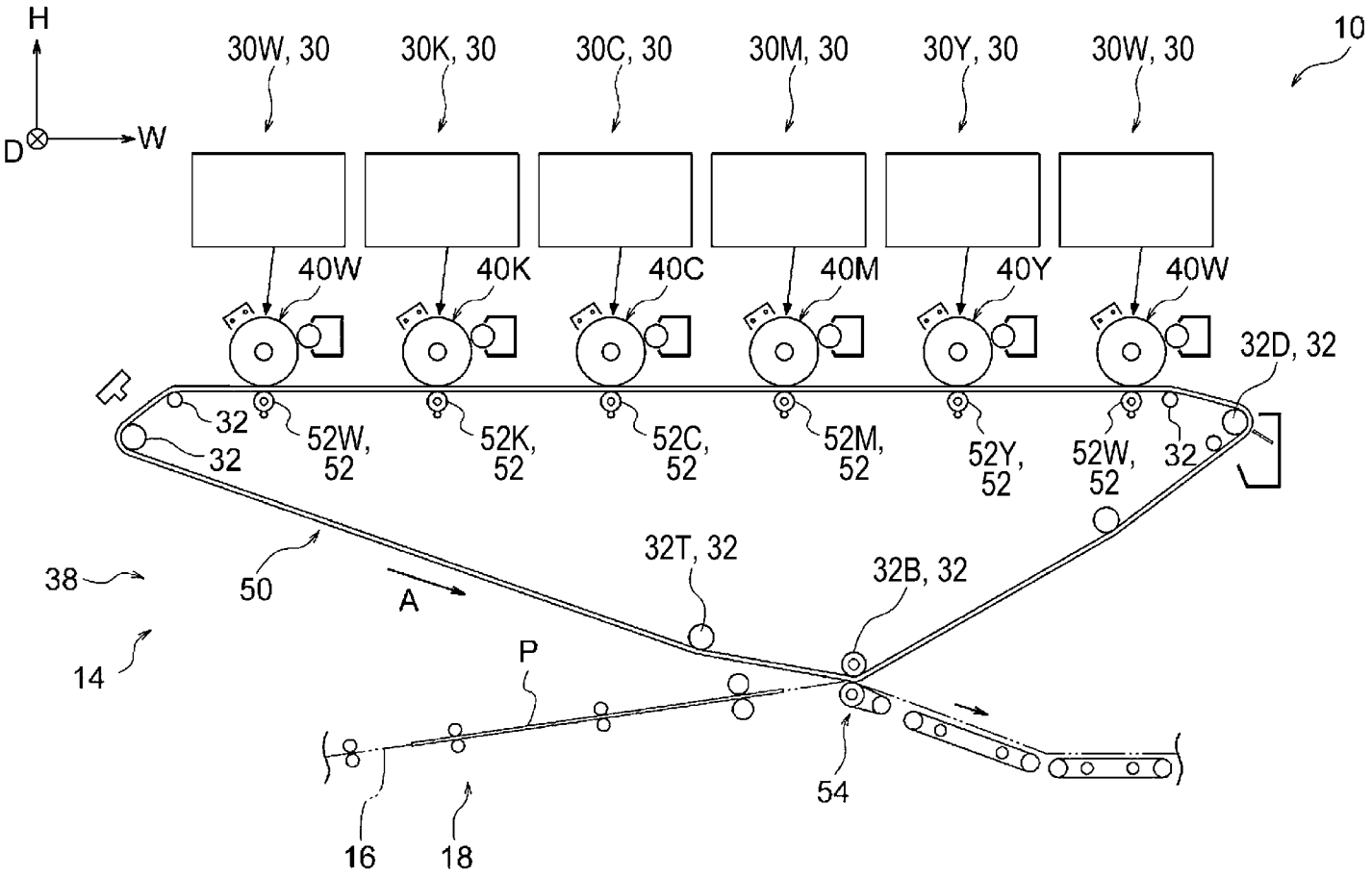
FIG. 4 is a diagram of a structure of the toner layer forming portion and a transfer portion of the image forming apparatus according to the first exemplary embodiment of the present invention.

Each image carrier 40 for the corresponding color is grounded and touches the rotating transfer belt 50 (described in detail below). As illustrated in FIG. 4, the toner layer forming portions 30 for white (W), yellow (Y), magenta (M), cyan (C), black (K), and white (W) are arranged in this order in the horizontal direction from the upstream side in the direction in which the transfer belt 50 is rotated (see the arrow A in the drawing).

As illustrated in FIG. 4, the transfer portion 14 includes first transfer rollers 52, which rotate and transfer toner layers formed on the image carriers 40 of the corresponding colors to the transfer belt 50. The transfer portion 14 also includes a second transfer portion 54, which transfers a toner image formed of one or more toner layers transferred to the transfer belt 50 onto a sheet member P. The transfer portion 14, the transfer belt 50, and the setting portion 58 are described in detail below.

As illustrated in FIG. 5, the fixing device 34 includes a fixing belt 60, which is wound around multiple rollers (not denoted with reference signs) and heated, and a pressing roller 62, which presses a sheet member P against the fixing belt 60.

In this structure, the rotating fixing belt 60 and the pressing roller 62 transport a sheet member P to which a toner image has been transferred while holding the sheet member P therebetween, so as to fix the toner image to the sheet member P.

Structure of Related Portions

The following describes toners used in the developing device 46, the transfer belt 50, serving as an example of a holding body, the transfer portion 14, serving as an example of a transfer body, and a setting portion 58, which sets a pressing force exerted to press the sheet member P against the transfer belt 50. The transfer belt 50, the transfer portion 14, and the setting portion 58 are included in a transfer device 38.

Toners Used in Developing Device 46

The developing device 46W employs a white toner (also referred to as "a W toner", below) 200, and the developing devices 46Y, 46M, 46C, and 46K employ color toners 300 for non-white colors. Now, the white toner 200 and the color toners 300 are described.

The white toner 200 is used on the sheet member P as a base coat for non-white colors. Specifically, a solid layer (solid image) of the white toner 200 is formed on a sheet member P as a base coat for non-white colors to enhance color reproduction of the toner image.

When the sheet member P, serving as a recording medium, is a paper medium, a W toner layer, a K toner layer, a C toner layer, a M toner layer, and a Y toner layer are superposed from top to bottom in this order on the sheet member P, which is a paper medium. When, on the other hand, the sheet member P serving as a recording medium is a transparent film, a K toner layer, a C toner layer, a M toner layer, a Y toner layer, and a W toner layer are superposed from top to bottom in this order on the sheet member P to allow an image to be viewed through the film.

White Toner 200

Figure 7A:
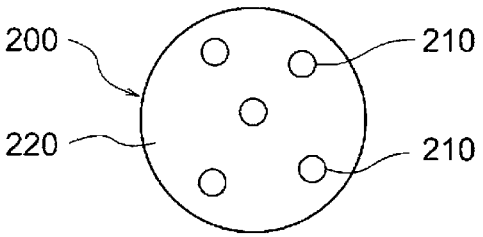
FIGS. 7A and 7B are schematic diagrams of a white toner and a color toner used in the image forming apparatus according to the first exemplary embodiment of the present invention.

As illustrated in FIG. 7A, the white toner 200 contains a spherical pigment 210 and a binding resin 220. The spherical pigment 210 is formed from a titanium oxide (an example of a metallic oxide). The binding resin 220 is formed from a known resin material. The binding resin 220 is less electrically conductive than the spherical pigment 210.

Figure 8A:
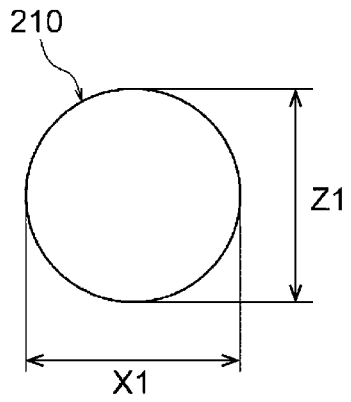
FIGS. 8A and 8B are schematic diagrams of a pigment of a white toner used in the image forming apparatus according to the first exemplary embodiment of the present invention.
Figure 8B:
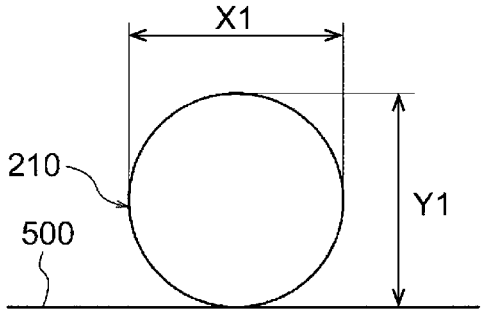

In the state where the spherical pigment 210 is placed on a flat surface 500, a lateral dimension X1 and a front-rear dimension Z1 of the spherical pigment 210, viewed from the top in FIG. 8A, are equal to the lateral dimension X1 and a vertical dimension Y1 of the spherical pigment 210, viewed from the side in FIG. 8B.

Figure 9A:
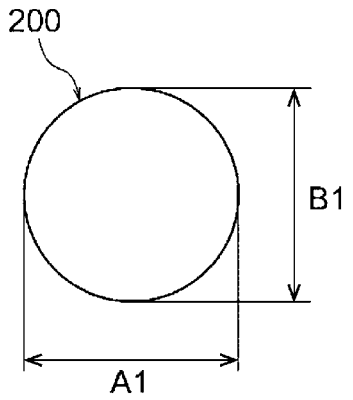
FIGS. 9A and 9B are schematic diagrams of a white toner used in the image forming apparatus according to the first exemplary embodiment of the present invention.
Figure 9B:
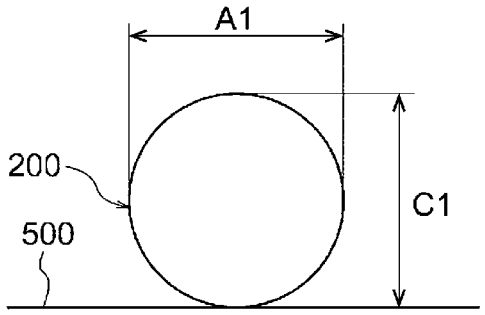

The white toner 200 containing the spherical pigment 210 is also spherical in the same manner as the spherical pigment 210. Thus, when the white toner 200 is placed on the flat surface 500, a lateral dimension A1 and a front-rear dimension B1 of the white toner 200, viewed from the top in FIG. 9A, are equal to the lateral dimension A1 and a vertical dimension C1 of the white toner 200, viewed from the side in FIG. 9B.

The volumetric average particle diameter of the spherical pigment 210 or the white toner 200 is measured by using, for example, Coulter counter TAII (from Nikkaki Bios Co., Ltd.) or Multisizer II (from Nikkaki Bios Co., Ltd.). Specifically, within a particle range (channel) separated on the basis of the particle size distribution measured with this measuring instrument, the cumulative distribution is plotted from the smaller diameter with respect to the volume, and the particle diameter (D50v) of the cumulative percentage of 50% is used as a volumetric average particle diameter. Other volumetric average particle diameters below are measured similarly.

The standard volumetric average particle diameter of the spherical pigment 210 falls within a range of approximately 200 nm to 300 nm. The standard volumetric average particle diameter of the white toner 200 falls within a range of approximately 4 μm to 14 μm.

In the present exemplary embodiment, the volumetric average particle diameter of the white toner 200 is 8.5 μm, and the specific gravity of the white toner 200 is 1.6 g/cm$^3$. Thus, the average mass (an example of mass) of the white toner 200 is $0.51\times10^{-9}$ g.

Color Toner 300

Figure 7B:
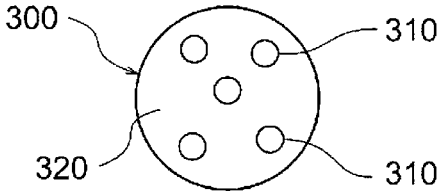

As illustrated in FIG. 7B, each color toner 300 does not contain the spherical pigment 210. The color toner 300 contains a pigment 310, other than the spherical pigment 210, and a binding resin 320. The pigment 310 is formed of, for example, a nonmetal and nonmetallic oxide pigment (for example, an organic pigment). Specifically, the color toner 300 contains a pigment less electrically conductive than the spherical pigment 210. The binding resin 320 is formed of a known resin material.

Figure 10A:
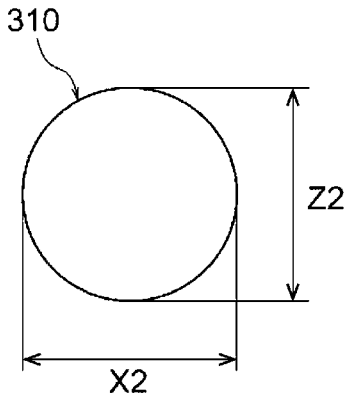
FIGS. 10A and 10B are schematic diagrams of a pigment of a color toner used in the image forming apparatus according to the first exemplary embodiment of the present invention.
Figure 10B:
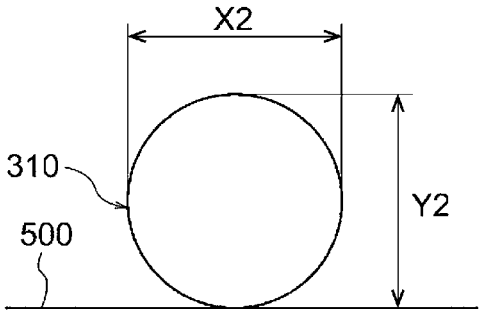

In the state where the spherical pigment 310 is placed on the flat surface 500, a lateral dimension X2 and a front-rear dimension Z2 of the spherical pigment 310, viewed from the top in FIG. 10A, are equal to the lateral dimension X2 and a vertical dimension Y2 of the spherical pigment 310, viewed from the side in FIG. 10B. Specifically, the pigment 310 is approximately spherical.

Figure 11A:
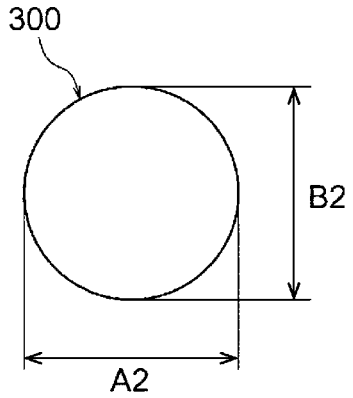
FIGS. 11A and 11B are schematic diagrams of a color toner used in the image forming apparatus according to the first exemplary embodiment of the present invention.
Figure 11B:
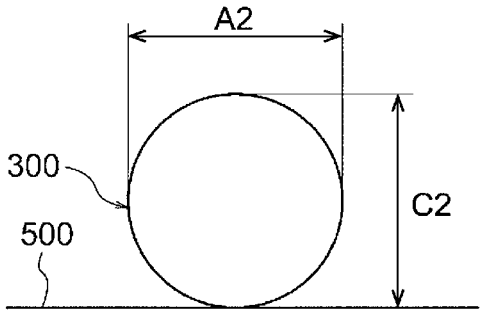

Similarly to the pigment 310, the color toner 300 containing the pigment 310 is also spherical. Thus, when the color toner 300 is placed on the flat surface 500, a lateral dimension A2 and a front-rear dimension B2 of the color toner 300, viewed from the top in FIG. 11A, are equal to the lateral dimension A2 and a vertical dimension C2, viewed from the side in FIG. 11B of the color toner 300.

The volumetric average particle diameter of the pigment 310 falls within the range of approximately 50 nm to 150 nm. The volumetric average particle diameter of the color toner 300 falls within the range of 3 μm to 9 μm. When the volumetric average particle diameter exceeds 9 μm, the image may have a low resolution. On the other hand, when the volumetric average particle diameter falls below 3 μm, the toner may be charged insufficiently and the developed image may have low quality.

Here, in the present exemplary embodiment, a toner having a specific gravity of 1.1 g/cm$^3$ and a volumetric average particle diameter of 4.7 μm is used as each of the Y toner, the M toner, and the C toner. A toner having a specific gravity of 1.2 g/cm$^3$ and a volumetric average particle diameter of 4.7 μm is used as the K toner. Thus, the Y toner, the M toner, and the C toner have a mass of $0.6\times10^{-10}$ g, and the K toner has a mass of $0.65\times10^{-10}$ g.

The color toner 300 may contain a compound formed from a divalent or polyvalent metallic element. The compound is added as, for example, a coagulant to form the color toner 300 by emulsion polymerization aggregation. The content of the compound in the color toner 300 falls within a range of, for example, 0.05 percent by mass to 2 percent by mass.

Transfer Belt 50

As illustrated in FIG. 4, the transfer belt 50 is endless and wound around multiple rollers 32. The transfer belt 50 is in a position of an inverted obtuse triangle, long in the apparatus width direction in a front view. In the present exemplary embodiment, the transfer belt 50 is made of a material obtained by dispersing carbon in polyimide. The transfer belt 50 has a volume resistivity of 12.5 log ohm-cm.

Transfer Portion 14

The transfer portion 14 includes multiple rollers 32, around which the transfer belt 50 is wound, and first transfer rollers 52 for various colors, which transfer the toner layers formed on the image carriers 40 for the various colors to the transfer belt 50. The transfer portion 14 also includes a second transfer portion 54, which transfers a toner image transferred to the transfer belt 50 to the sheet member P, and eccentric cams 72 (see FIGS. 1A and 1B), which move a roller 32B, described below.

Rollers 32

The multiple rollers 32 include a roller 32D disposed on a first end (on the right side) in the apparatus width direction. The roller 32D rotates the transfer belt 50 in the direction of arrow A (counterclockwise in the drawing) with a rotational force transmitted from a motor, not illustrated. In the present exemplary embodiment, the roller 32D is a cylindrical metal roller having an outer diameter of 28 mm.

Figure 1A:
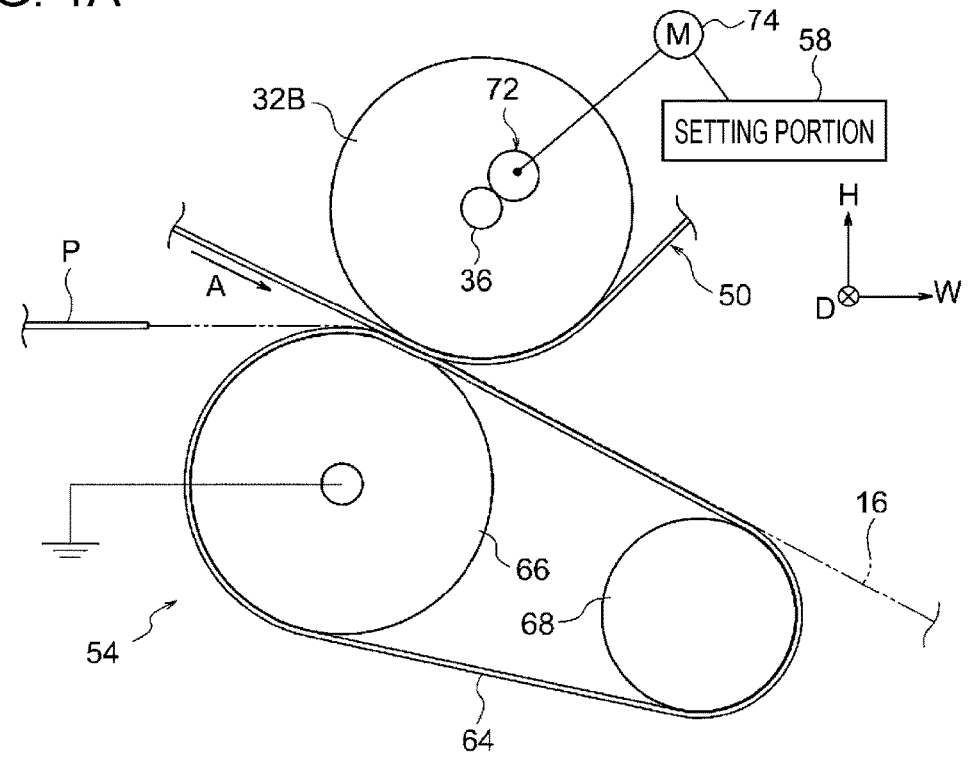
FIGS. 1A and 1B are sectional views of components including a second transfer portion and a transfer belt of an image forming apparatus according to a first exemplary embodiment of the present invention.
Figure 1B:
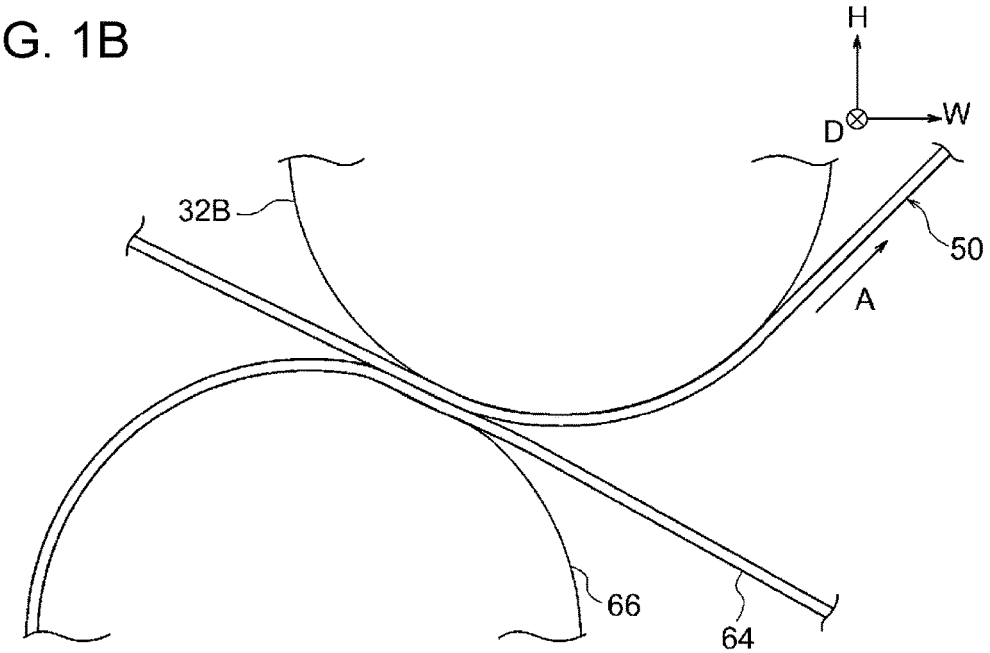

The multiple rollers 32 include a roller 32B, around which the lower end vertex of the transfer belt 50 taking an obtuse triangle position is wound to form an obtuse angle. As illustrated in FIG. 1A, the roller 32B includes a rotation shaft 36, which has a smaller diameter than the outer diameter of the roller 32B. The roller 32B also includes a guiderail, not illustrated, for guiding the rotation shaft 36 so that the roller 32B moves toward and away from the second transfer portion 54.

The roller 32B faces the second transfer portion 54 with the transfer belt 50 interposed therebetween. A transfer current is fed to the roller 32B. In the present exemplary embodiment, the roller 32B is an elastic roller having an outer diameter of 28 mm. The roller 32B has a surface resistance of 7.3 log ohm/sq. The roller 32B has a surface hardness of 53 degrees in Asker C hardness.

As illustrated in FIG. 4, the multiple rollers 32 include a roller 32T on the upstream side of and adjacent to the roller 32B in the direction in which the transfer belt 50 rotates (hereinafter referred to as "a belt rotation direction"). The roller 32T applies a tension to the transfer belt 50. Specifically, a slop portion of the transfer belt 50 is wound around the roller 32T. The slop portion of the transfer belt 50 tilts from the horizontal direction. In the present exemplary embodiment, the roller 32T is a cylindrical metal roller having an outer diameter of 28 mm.

Eccentric Cams 72

As illustrated in FIG. 1A, a pair of eccentric cams 72 are disposed so as to hold the roller 32B therebetween in the apparatus depth direction such that the outer circumferential surfaces of the eccentric cams 72 touch the rotation shaft 36 of the roller 32B. On the outer circumferential surface of each eccentric cam 72, an urging member, not illustrated, is disposed. The urging member urges the rotation shaft 36 of the roller 32B to bring the rotation shaft 36 into contact with the corresponding eccentric cam 72.

Figure 2A:
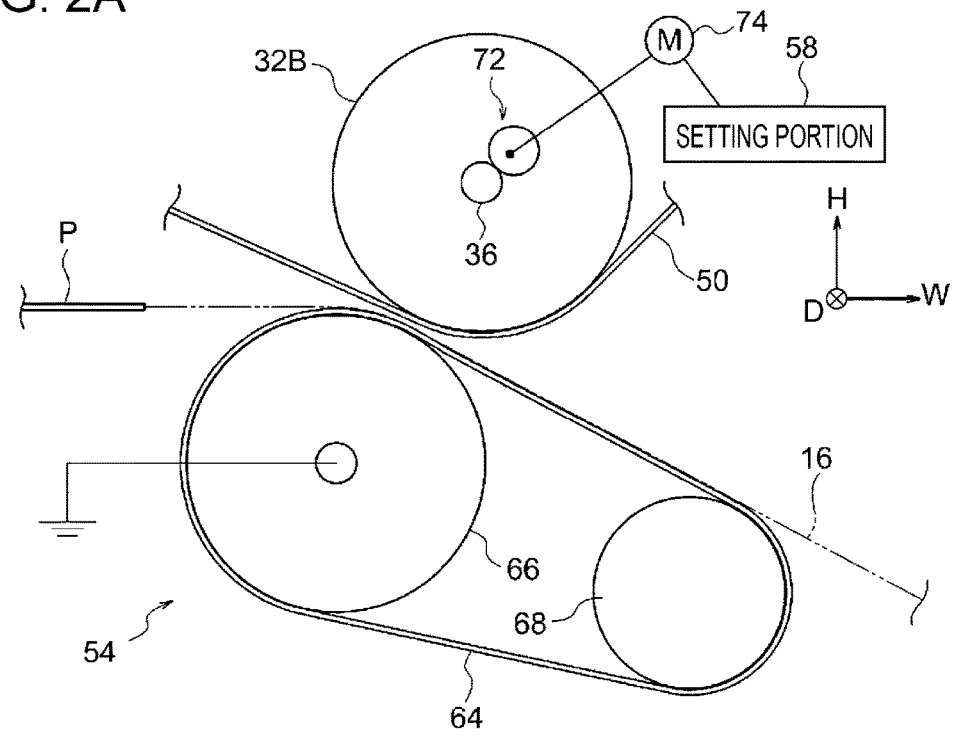
FIGS. 2A and 2B are sectional views of components including a second transfer portion and a transfer belt of an image forming apparatus according to the first exemplary embodiment of the present invention.

In this structure, the eccentric cams 72 rotate with the rotational force of a stepping motor 74 ("the motor 74", below), which rotates the eccentric cams 72, to move the roller 32B toward and away from the second transfer portion 54 (see FIGS. 1A and 2A).

First Transfer Roller 52

As illustrated in FIG. 4, the first transfer rollers 52 are disposed so as to face the image carriers 40 of the respective colors with the transfer belt 50 interposed therebetween. In the present exemplary embodiment, the first transfer rollers 52 are elastic rollers having an outer diameter of 28 mm. The first transfer rollers 52 have a resistance of 7.71 log ohm and the first transfer rollers 52 have a surface hardness of 30 degrees in Asker C hardness.

In this structure, when a transfer current is fed to each of the first transfer rollers 52 of the corresponding color, a transfer electric field is formed between the first transfer roller 52 and the corresponding image carrier 40. This transfer electric field transfers the toner layers on the image carriers 40 to the transfer belt 50, so that the transfer belt 50 holds a toner image formed from one or more toner layers.

Second Transfer Portion 54

As illustrated in FIG. 1A, the second transfer portion 54 includes an endless elastic belt 64, and rollers 66 and 68, around which the elastic belt 64 is wound.

In the present exemplary embodiment, the elastic belt 64 is a rubber belt having a thickness of 450 μm and a perimeter of 40 mm. The elastic belt 64 has a volume resistance of 9.2 log ohm.

The roller 66 is grounded and disposed so as to hold the transfer belt 50 and the elastic belt 64 between the roller 66 and the roller 32B. In the present exemplary embodiment, the roller 66 is an elastic roller having an outer diameter of 28 mm. The roller 66 has a resistance of 6.3 log ohm.

The roller 68 is located on the downstream side of the roller 66 in the direction in which the sheet member P is transported along the transport path 16 (hereinafter referred to as "a sheet transport direction"). In the present exemplary embodiment, the roller 68 is a cylindrical metal roller having an outer diameter of 20 mm.

In this structure, a sheet member P transported while being held between the transfer belt 50 and the second transfer portion 54 is pressed against the transfer belt 50. When a transfer current is fed to the roller 32B, a transfer electric field is formed between the roller 32B and the roller 66 of the second transfer portion 54. This transfer electric field transfers the toner image on the transfer belt 50 to the sheet member P that is being transported.

Setting Portion 58

As illustrated in FIG. 1A, the setting portion 58 drives the motor 74 to rotate the eccentric cams 72. The setting portion 58 moves the roller 32B to a position at which the center of rotation of the roller 32B and the center of rotation of the roller 66 are closest to each other (see FIGS. 1A and 1B), and to a position at which the center of rotation of the roller 32B and the center of rotation of the roller 66 are farthest from each other (see FIGS. 2A and 2B).

In the present exemplary embodiment, when the roller 32B is moved to the position at which the center of rotation of the roller 32B and the center of rotation of the roller 66 are closest to each other, the transfer belt 50 depresses the elastic belt 64 of the second transfer portion 54 (see FIG. 1B) by 0.3 mm. In other words, the amount of depression is 0.3 mm.

Figure 2B:
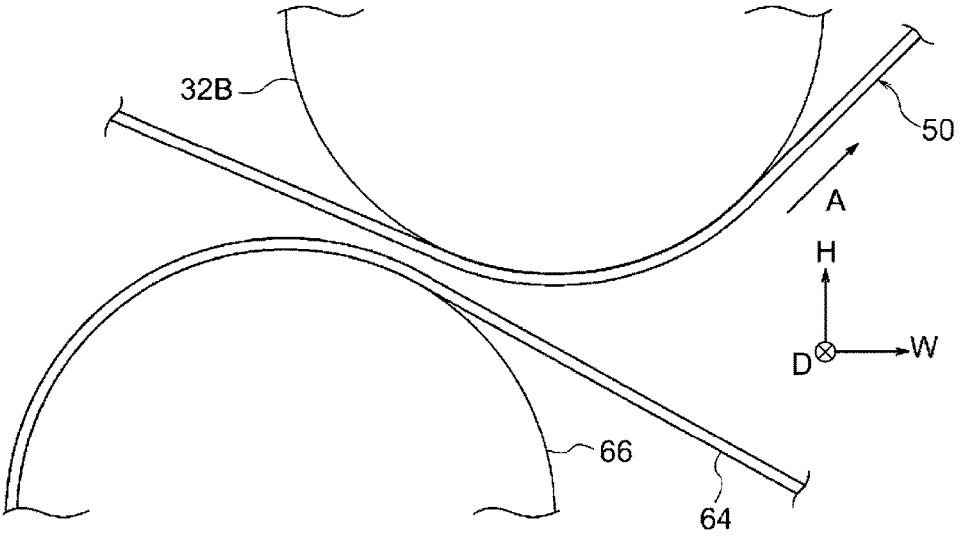

On the other hand, when the roller 32B is moved to the position at which the center of rotation of the roller 32B and the center of rotation of the roller 66 are farthest from each other, the transfer belt 50 is spaced 0.5 mm apart from the elastic belt 64 of the second transfer portion 54 (see FIG. 2B). In other words, the amount of depression is −0.5 mm.

In this structure, the setting portion 58 receives from a controller, not illustrated, information of the mass of toner (toner particles) of the uppermost toner layer in the toner image on the transfer belt 50. When the mass of the toner is equal to or exceeds a threshold, the setting portion 58 changes the amount of depression by which the transfer belt 50 depresses the elastic belt 64 to −0.5 mm.

In the present exemplary embodiment, the threshold of the mass of the toner (toner particles) is set at, for example, $0.2\times10^{-9}$ g.

When the mass of the toner of the uppermost toner layer in the toner image on the transfer belt 50 falls below the threshold, the setting portion 58 changes the amount of depression by which the transfer belt 50 depresses the elastic belt 64 to 0.3 mm. Thus, the sheet member P to which the toner image is to be transferred is pressed against the transfer belt 50 with a greater pressing force (hereinafter referred to as "a first pressing force") than in the case where the amount of depression by which the transfer belt 50 depresses the elastic belt 64 is −0.5 mm.

In other words, the setting portion 58 presses the sheet member P against the transfer belt 50 with a pressing force smaller than the first pressing force (hereinafter the smaller force is referred to as "a second pressing force") when the mass of the toner of the uppermost toner layer on the transfer belt 50 is equal to or exceeds the threshold.

Evaluations

Now, evaluations of an image forming apparatus 910 according to a comparative example and the image forming apparatus 10 according to the present exemplary embodiment are described. Firstly, the structure of the image forming apparatus 910 according to a comparative example is described. Then, the evaluations of the image forming apparatus 910 according to a comparative example and the image forming apparatus 10 according to the present exemplary embodiment are described.

Image Forming Apparatus 910 According to Comparative Example

Firstly, portions of the image forming apparatus 910 according to a comparative example that differ from those of the image forming apparatus 10 are mostly described.

Figure 17:
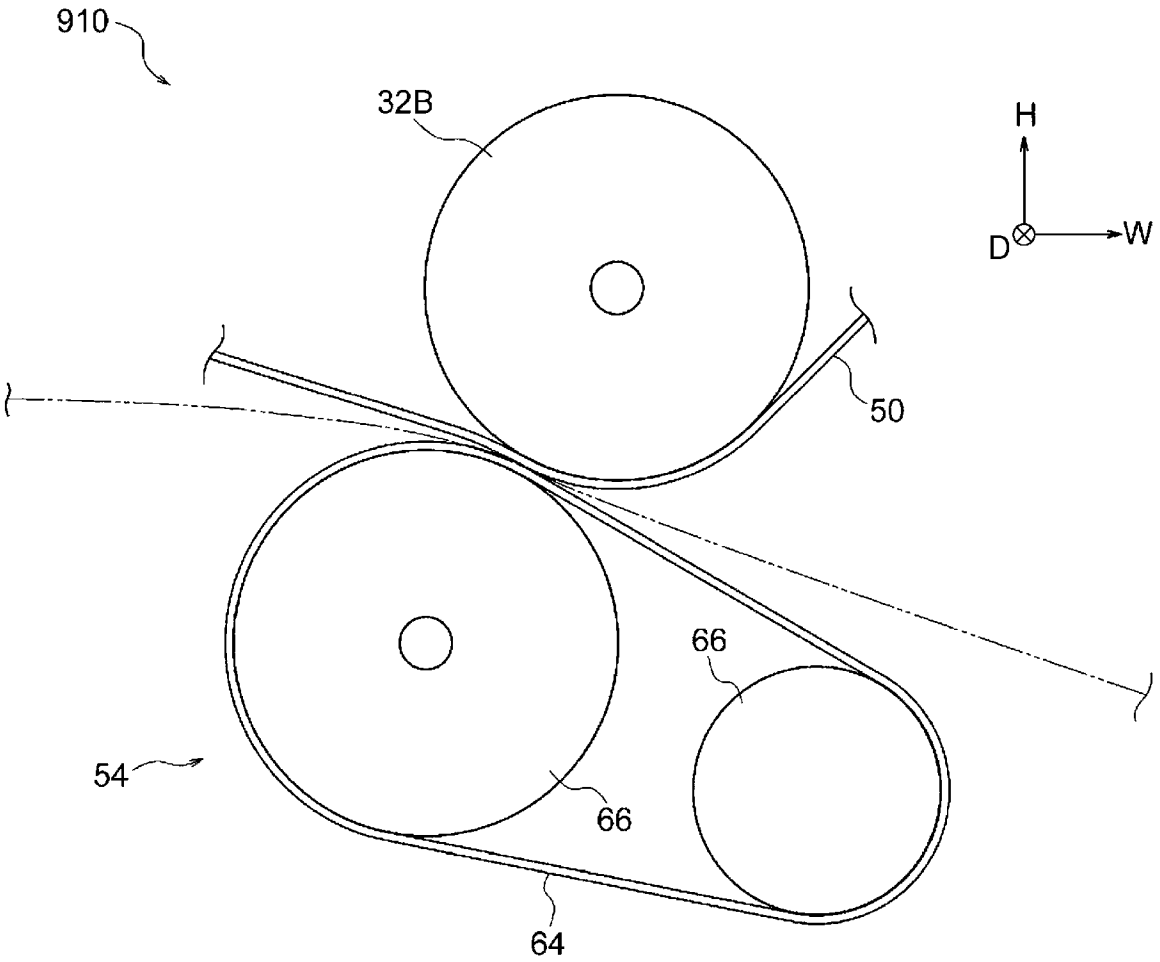
FIG. 17 is a sectional view of components including a second transfer portion and a transfer belt of an image forming apparatus according to a comparative example in comparison with the image forming apparatus according to the first exemplary embodiment of the present invention.

As illustrated in FIG. 17, a roller 32B of the image forming apparatus 910 according to a comparative example is rendered unmovable. The relative positional relationship between the roller 32B and the roller 66 of the image forming apparatus 910 is the same as that when the center of rotation of the roller 32B and the center of rotation of the roller 66 in the image forming apparatus 10 are closest to each other. Specifically, the amount of depression by which the transfer belt 50 depresses the elastic belt 64 is maintained constant at 0.3 mm. Thus, the sheet member P to which the toner image is to be transferred is constantly pressed against the transfer belt 50 with the first pressing force, which is greater than the second pressing force.

Evaluations

The evaluations of the image forming apparatus 10 and the image forming apparatus 910 are described now.

Evaluation Specifications

Evaluations are performed using a machine obtained by converting Color 1000 Press from Fuji Xerox Co., Ltd. into the image forming apparatus 10 and a machine obtained by converting Color 1000 Press from Fuji Xerox Co., Ltd. into the image forming apparatus 910. The process speed of the image forming apparatus 10 and the image forming apparatus 910 is set at 524 mm/s.

The evaluations are performed in the surrounding of the room temperature of 28° C. and the humidity of 85% RH.

The toner mass per area (TMA, mass of toner per unit area) of the Y toner, the M toner, and the C toner is set at 3.3 g/m$^2$, the TMA of the K toner is set at 3.7 g/m$^2$, and the TMA of the W toner is set at 8.2 g/m$^2$.

The toner layer forming portion 30W used in the evaluations is the one disposed downstream (to the left in FIG. 4), in the belt rotation direction, of the non-white color toner layer forming portions 30Y, 30M, 30C, and 30K, and not the one disposed upstream of the non-white color toner layer forming portions 30Y, 30M, 30C, and 30K.

The evaluations are performed using metallic sheets from Gojo Paper MFG. Co., Ltd. (product No. 215-256, basis weight of 256 g/m$^2$, and thickness of 0.3 mm) and metallic sheets from Gojo Paper MFG. Co., Ltd. (product No. 220-1, basis weight of 350 g/m2, and thickness of 0.5 mm). In the following description, the metallic sheets of the basis weight of 256 g/m$^2$ may be referred to as "ordinary paper sheets", and the metallic sheets of the basis weight of 350 g/m$^2$ may be referred to as "thick paper sheets".

Evaluation Images

Figure 16:
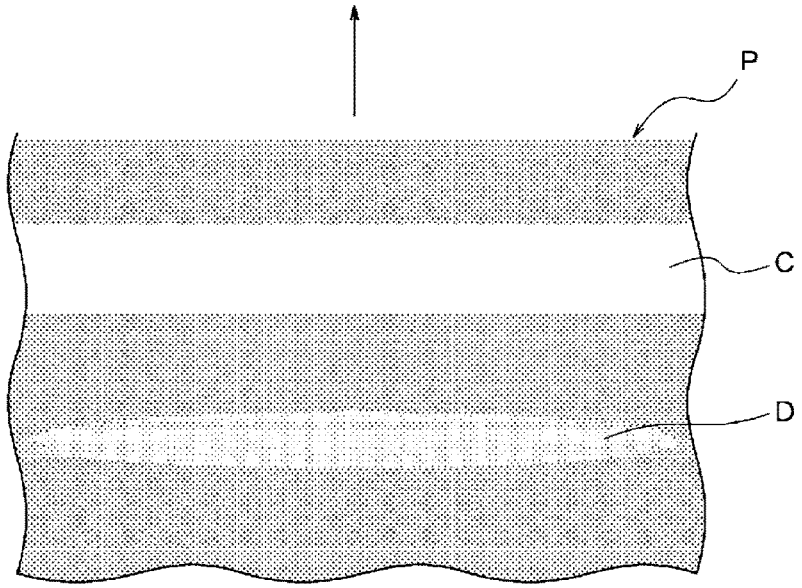
FIG. 16 is a schematic diagram of the evaluation results on an image forming apparatus according to a comparative example in comparison with the evaluation results on the image forming apparatus according to the first exemplary embodiment of the present invention in relation to toner scattering on a recording medium.

A belt-like solid image (portion C in FIG. 16 having a width of 10 mm in the sheet transport direction (process direction) for each color is output on each of the ordinary paper sheets and the thick paper sheets from the position 20 mm apart from the leading end of each sheet.

Evaluation Method

Output images are each visually inspected, and rated "poor" if the image has low image quality due to, for example, toner scattering, or rated "fair" if the image is acceptable as a product even with toner scattering.

Evaluation Results

Firstly, the evaluation results of the image forming apparatus 910 are described with the table shown in FIG. 12B.

As shown in the table in FIG. 12B, a toner image is formed with the W toner by the image forming apparatus 910 and, rated "poor" in an evaluation result when using a thick paper sheet. Other toner images are rated "fair" in different evaluation results. As illustrated in FIG. 16, the output image rated "poor" in the evaluation result has a portion (portion D in FIG. 16) to which scattering toner adheres at a position apart from the trailing end of the belt-like solid image (portion C in FIG. 16) having a width of 10 mm.

The reason why the image is rated "poor" in the evaluation result is considered below.

Figure 18A:
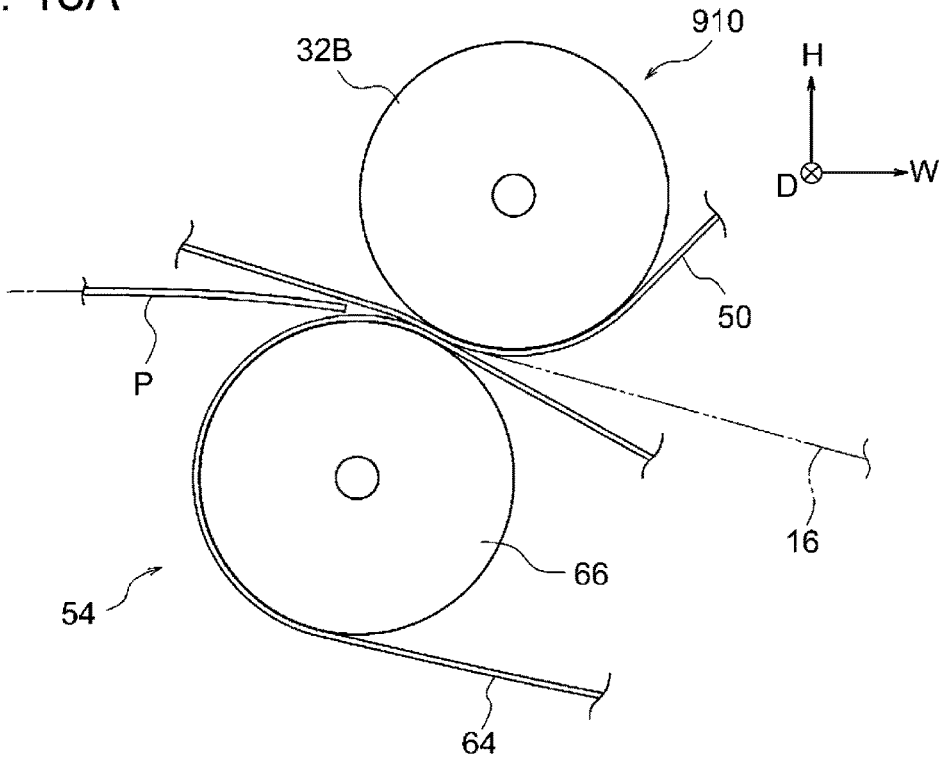
FIGS. 18A and 18B are sectional views of components including a second transfer portion and a transfer belt of an image forming apparatus according to a comparative example in comparison with the image forming apparatus according to the first exemplary embodiment of the present invention.
Figure 18B:
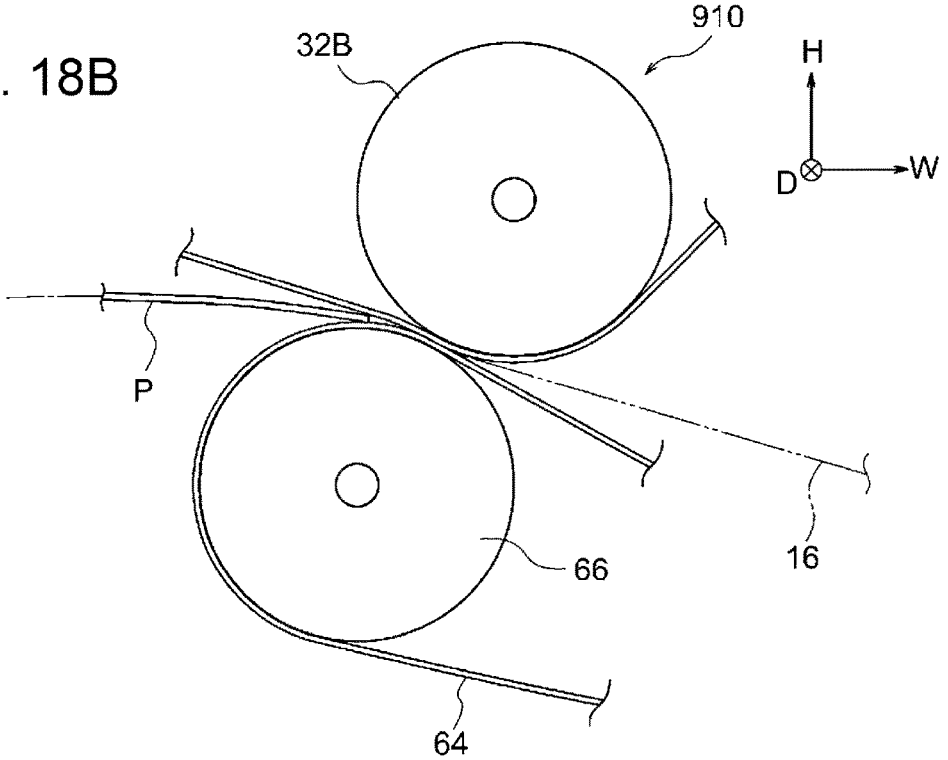
Figure 19A:
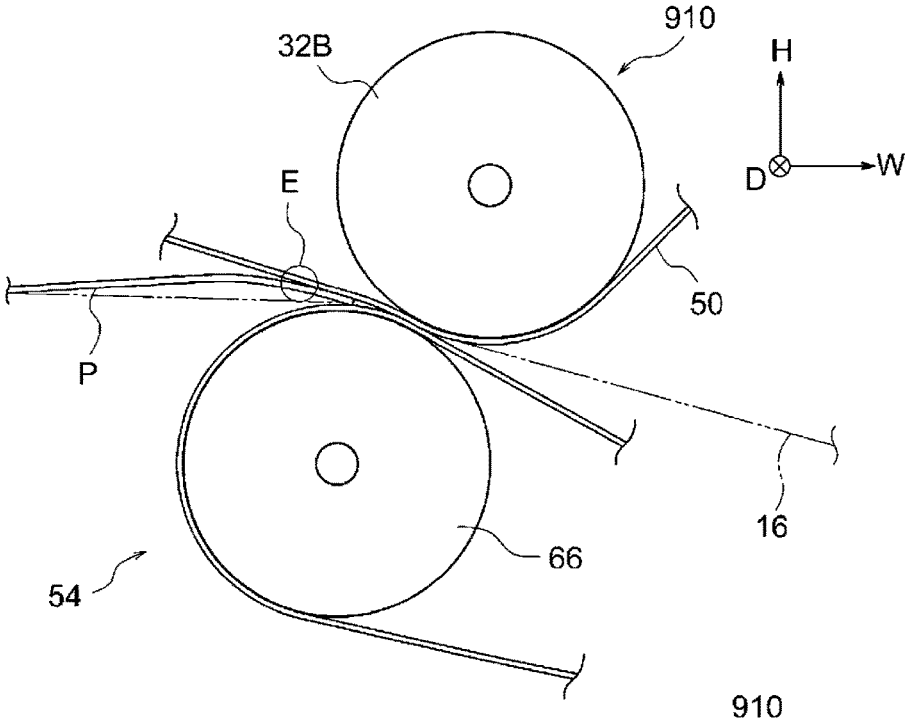
FIGS. 19A and 19B are sectional views of components including a second transfer portion and a transfer belt of an image forming apparatus according to a comparative example in comparison with the image forming apparatus according to the first exemplary embodiment of the present invention.
Figure 19B:
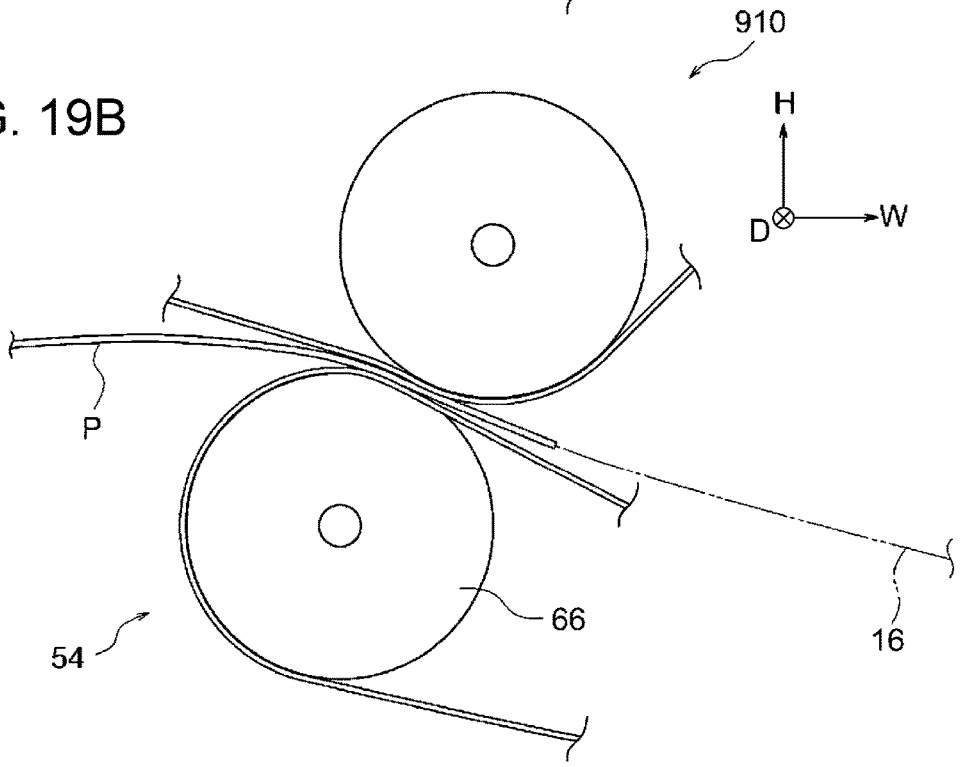

As illustrated in FIG. 18A, a sheet member P (thick paper sheet) on which a toner image is formed is transported toward the pressing portion (nip portion) formed between the roller 32B and the second transfer portion 54. As illustrated in FIGS. 18B and 19A, when the leading end of the transported sheet member P hits the pressing portion or a portion narrowed between the transfer belt 50 and the elastic belt 64, the leading end portion of the sheet member P is bent and collides with the transfer belt 50 (portion E in FIG. 19A). This collision vibrates the transfer belt 50 and scatters part of the W toner on the transfer belt 50, and the scattering toner adheres to the rotating transfer belt 50 again. The above-described output image (see FIG. 16) is possibly formed in this manner. As illustrated in FIG. 19B, the sheet member P having its leading end portion temporarily bent is transported while being held between the transfer belt 50 and the second transfer portion 54 and while being pressed against the transfer belt 50.

Now, the reason why only the W toner scatters is considered.

Figure 13:
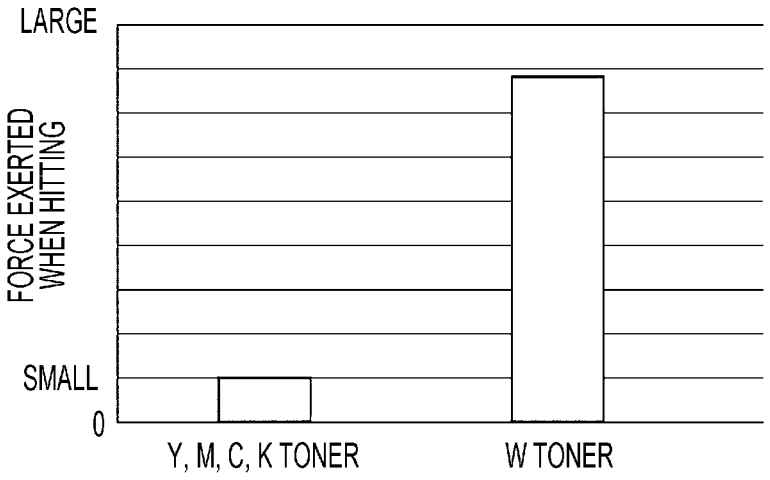
FIG. 13 is a graph of the evaluation results of a white toner and color toners used in the image forming apparatus according to a first exemplary embodiment of the present invention.

FIG. 13 illustrates a force exerted on each toner when the transfer belt 50 vibrates. The same vibration (acceleration) exerts a larger force on the W toner having a larger mass than a force on the Y, M, C, and K toners having a smaller mass. This is probably the reason why part of the W toner on the transfer belt 50 scatters while the Y, M, C, and K toners on the transfer belt 50 do not scatter.

Now, the reason why the W toner do not scatter when transferred to an ordinary paper sheet but scatters when transferred to a thick paper sheet is considered.

The thick paper sheet has a larger basis weight than the ordinary paper sheet. In other words, the thick paper sheet has higher flexural rigidity than the ordinary paper sheet. As illustrated in FIGS. 18B and 19A, the force exerted when the bent leading end portion of the sheet member P collides with the transfer belt 50 is higher in the case where the sheet member P is a thick paper sheet than that in the case where the sheet member P is an ordinary paper sheet.

Thus, the acceleration generated in the transfer belt 50 when the thick paper sheet collides with the transfer belt 50 is faster than the acceleration generated in the transfer belt 50 when the ordinary paper sheet collides with the transfer belt 50. This is possibly the reason why the W toner scatters when the W toner is transferred to the thick paper sheet.

The evaluation results of the image forming apparatus 10 are described using the table shown in FIG. 12A.

As described above, the setting portion 58 of the image forming apparatus 10 separates the roller 32B and the roller 66 from each other when the mass of the toner of the uppermost toner layer in the toner image on the transfer belt 50 is equal to or exceeds the threshold. In the present exemplary embodiment, the threshold of the mass of the toner is $0.20\times10^{-9}$ g. As described above, the mass of the W toner (toner particles) is $0.51\times10^{-9}$ g, which is greater than the threshold.

When the setting portion 58 separates the roller 32B and the roller 66 from each other when the W toner is used in the uppermost toner layer of the transfer belt 50, the amount of depression by which the transfer belt 50 depresses the elastic belt 64 is set at −0.5 mm. In other words, when the W toner is to be used, the image forming apparatus 10 sets the pressing force exerted to press the sheet member P against the transfer belt 50 at the second pressing force, which is smaller than the first pressing force.

As shown in the table in FIG. 12A, when the image forming apparatus 10 forms toner images also when using the W toner on the thick paper sheet, all the toner images are rated "fair" in the evaluation results.

Now, the reason why the toner image formed on the thick paper sheet with the W toner is rated "fair" in the evaluation result is considered. The relevant toner image formed by the image forming apparatus 910 is rated "poor" in the evaluation result.

Figure 14:
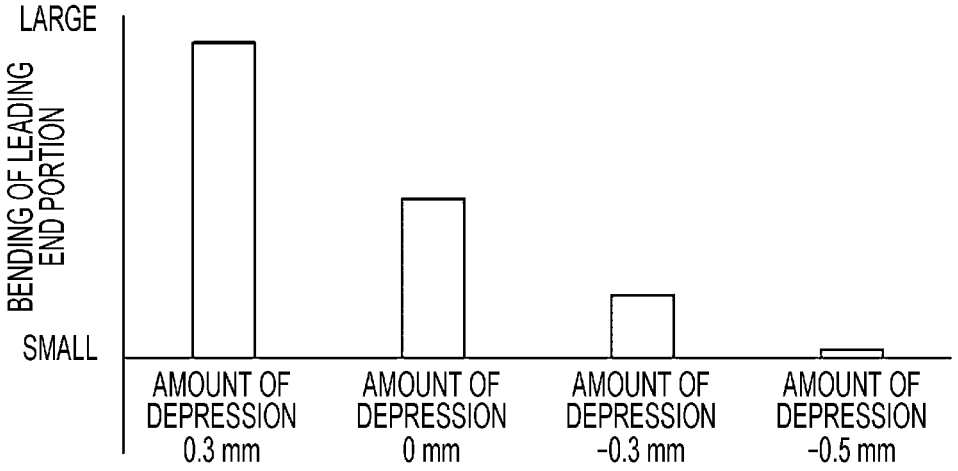
FIG. 14 is a graph showing the relationship between an amount of depression and the bendability of a recording medium used in the image forming apparatus according to the first exemplary embodiment of the present invention.

FIG. 14 shows a graph of the bending of the leading end portion of the sheet member P generated when the thick paper sheet is brought into contact with the pressing portion formed between the roller 32B and the second transfer portion 54. The amount of the bending is examined by visually inspecting a captured image of the transported thick paper sheet.

Specifically, the bending produced at the leading end portion of the sheet member P when the amount of depression by which the transfer belt 50 depresses the elastic belt 64 is changed to 0.3 mm, 0 mm, −0.3 mm, and −0.5 mm is evaluated. As is clear from the table shown in FIG. 14, the bending is reduced as the amount of depression is reduced. In other words, the bending is reduced as the pressing force exerted to press the sheet member P against the transfer belt 50 is reduced.

As described above, when the W toner is to be used, the image forming apparatus 10 sets the pressing force exerted to press the sheet member P against the transfer belt 50 at the second pressing force, which is smaller than the first pressing force. Thus, in the image forming apparatus 10, the bending of the leading end portion of the sheet member P is reduced compared to the case where the image forming apparatus 910 is used. This structure is thus considered to reduce the scattering of the W toner on the transfer belt 50 as a result of the reduction of the force with which the bent leading end portion of the sheet member P collides with the transfer belt 50.

Alternatively, the scattering of the W toner on the transfer belt 50 may be reduced by constantly keeping the pressing force exerted to press the sheet member P against the transfer belt 50 low.

Figure 15:
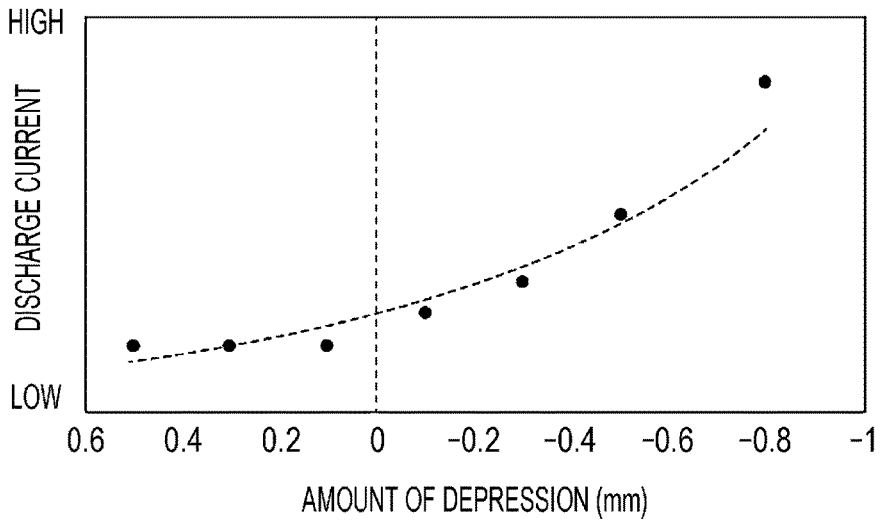
FIG. 15 is a graph showing the relationship between an amount of depression and an amount of electric discharge of a transfer portion used in the image forming apparatus according to the first exemplary embodiment of the present invention.

The graph in FIG. 15 shows the relationship between the amount of depression by which the transfer belt 50 depresses the elastic belt 64 and the discharge current produced between the roller 32B and the roller 66. Specifically, the vertical axis in the graph shows the discharge current and the horizontal axis in the graph shows the amount of depression. As shown from the graph, the discharge current increases as the amount of depression decreases (as the roller 32B and the roller 66 are spaced further apart from each other). In other words, the discharge current increases as the pressing force exerted to press the sheet member P against the transfer belt 50 decreases.

Thus, when the pressing force exerted to press the sheet member P against the transfer belt 50 is constantly kept small, the discharge current is constantly kept high, so that the durability of the roller 32B and the roller 66 decreases. Specifically, in the image forming apparatus 10, the pressing force exerted to press the sheet member P against the transfer belt 50 is reduced only when needed, to minimize the quality degradation of an output image and minimize the durability reduction of the roller 32B and the roller 66.

Operations of Related Components

The operations of related components are described now.

First, the case where a toner image is formed by using only the Y, M, C, and K color toners 300 is described. Here, a thick paper sheet is used as the sheet member P. The image forming apparatus 10 that has not started an image forming operation (before job execution) has a setting of the amount of depression by which the transfer belt 50 depresses the elastic belt 64 at 0.3 mm. In other words, the image forming apparatus 10 has a setting of the pressing force exerted to press the sheet member P against the transfer belt 50 at the first pressing force.

Figure 6A:
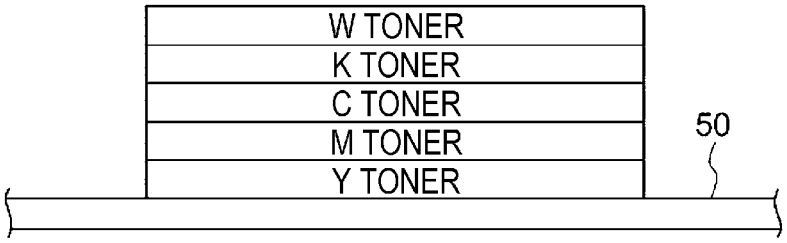
FIGS. 6A and 6B are schematic diagrams of a toner image obtained by superposing toner layers on a transfer belt using the image forming apparatus according to the first exemplary embodiment of the present invention.
Figure 6B:
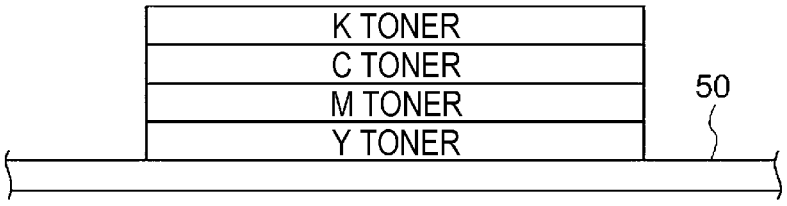

Toner layers formed by the toner layer forming portions 30Y, 30M, 30C, and 30K are first-transferred to the rotating transfer belt 50 by the first transfer rollers 52 (FIG. 4). As illustrated in FIG. 6B, the toner image obtained by superposing the Y toner layer, the M toner layer, the C toner layer, and the K toner layer in this order is formed (held) on the transfer belt 50. Here, the uppermost one of the toner layers disposed on the transfer belt 50 and constituting the toner image is the K toner layer. The mass of the toner of the uppermost toner layer is $0.7\times10^{-10}$ g, which is below the threshold. Thus, the setting portion 58 keeps the amount of depression by which the transfer belt 50 depresses the elastic belt 64 at 0.3 mm. In other words, the setting portion 58 maintains the pressing force exerted to press the sheet member P against the transfer belt 50 at the first pressing force, which is greater than the second pressing force.

When the transported sheet member P is then transported while being held between the transfer belt 50 and the second transfer portion 54 and while being pressed against the rotating transfer belt 50, the superposed toner image on the transfer belt 50 is transferred to the sheet member P (see FIG. 4).

Now, described is a case where a toner image including the W toner layer as a base coat for the Y, M, C, and K color toners 300 is formed to enhance the color reproducibility. A device disposed downstream (to the left in FIG. 4) of the non-white color toner layer forming portions 30Y, 30M, 30C, and 30K in the belt rotation direction is used as the toner layer forming portion 30W that forms the W toner layer. Thick paper sheets are used as the sheet members P. The image forming apparatus 10 that has not started an image forming operation (before job execution) has a setting of the amount of depression by which the transfer belt 50 depresses the elastic belt 64 at 0.3 mm. In other words, the image forming apparatus 10 has a setting of the pressing force exerted to press the sheet member P against the transfer belt 50 at the first pressing force.

The toner layers formed by the toner layer forming portions 30Y, 30M, 30C, 30K, and 30W are first-transferred to the rotating transfer belt 50 by the respective first transfer rollers 52 (FIG. 4). As illustrated in FIG. 6A, a toner image obtained by superposing the Y toner layer, the M toner layer, the C toner layer, the K toner layer, and the W toner layer in this order is formed (held) on the transfer belt 50. Here, the uppermost one of the toner layers disposed on the transfer belt 50 and constituting the toner image is the W toner layer. The mass information of the W toner is input in advance. The mass of the toner of the uppermost toner layer is $0.51\times10^{-6}$ g, which exceeds the threshold. Thus, the setting portion 58 changes the amount of depression by which the transfer belt 50 depresses the elastic belt 64 to −0.5 mm. In other words, the setting portion 58 sets the pressing force exerted to press the sheet member P against the transfer belt 50 at the second pressing force, which is smaller than the first pressing force.

The transported sheet member P is transported while being held between the transfer belt 50 and the second transfer portion 54 and while being pressed against the rotating transfer belt 50, so that the superposed toner image on the transfer belt 50 is transferred to the sheet member P (see FIG. 4).

CONCLUSION

As described above, when the uppermost one of the toner layers on the transfer belt 50 is the W toner layer, the mass of the toner of the uppermost toner layer is equal to or exceeds the threshold. Thus, the image forming apparatus 10 sets the pressing force exerted to press the sheet member P against the transfer belt 50 at the second pressing force, which is smaller than the first pressing force. This structure prevents the transfer belt 50 from vibrating as a result of the leading end of the transported sheet member P coming into contact with the pressing portion, and thus prevents the W toner on the transfer belt 50 from scattering.

In other words, compared to the structure where the pressing force exerted to press the sheet member P against the transfer belt 50 is kept constant at the first pressing force, this structure reduces the amount of the W toner on the transfer belt 50 that scatters due to the impact occurring when the transported sheet member P comes into contact with the pressing portion.

Reducing the scattering of the W toner on the transfer belt 50 reduces the quality degradation of the images transferred to the sheet member P compared to the structure where the pressing force exerted to press the sheet member P against the transfer belt 50 is kept constant at the first pressing force.

As described above, the image forming apparatus 10 reduces the pressing force exerted to press the sheet member P against the transfer belt 50 only when needed, to minimize the quality degradation of an output image and minimize the durability reduction of the roller 32B and the roller 66.

Second Embodiment

Examples of a transfer device and an image forming apparatus according to a second exemplary embodiment of the present invention are described with reference to FIGS. 20 to 24B. Here, portions of the second exemplary embodiment that differ from those of the first exemplary embodiment are mostly described.

Figure 20:
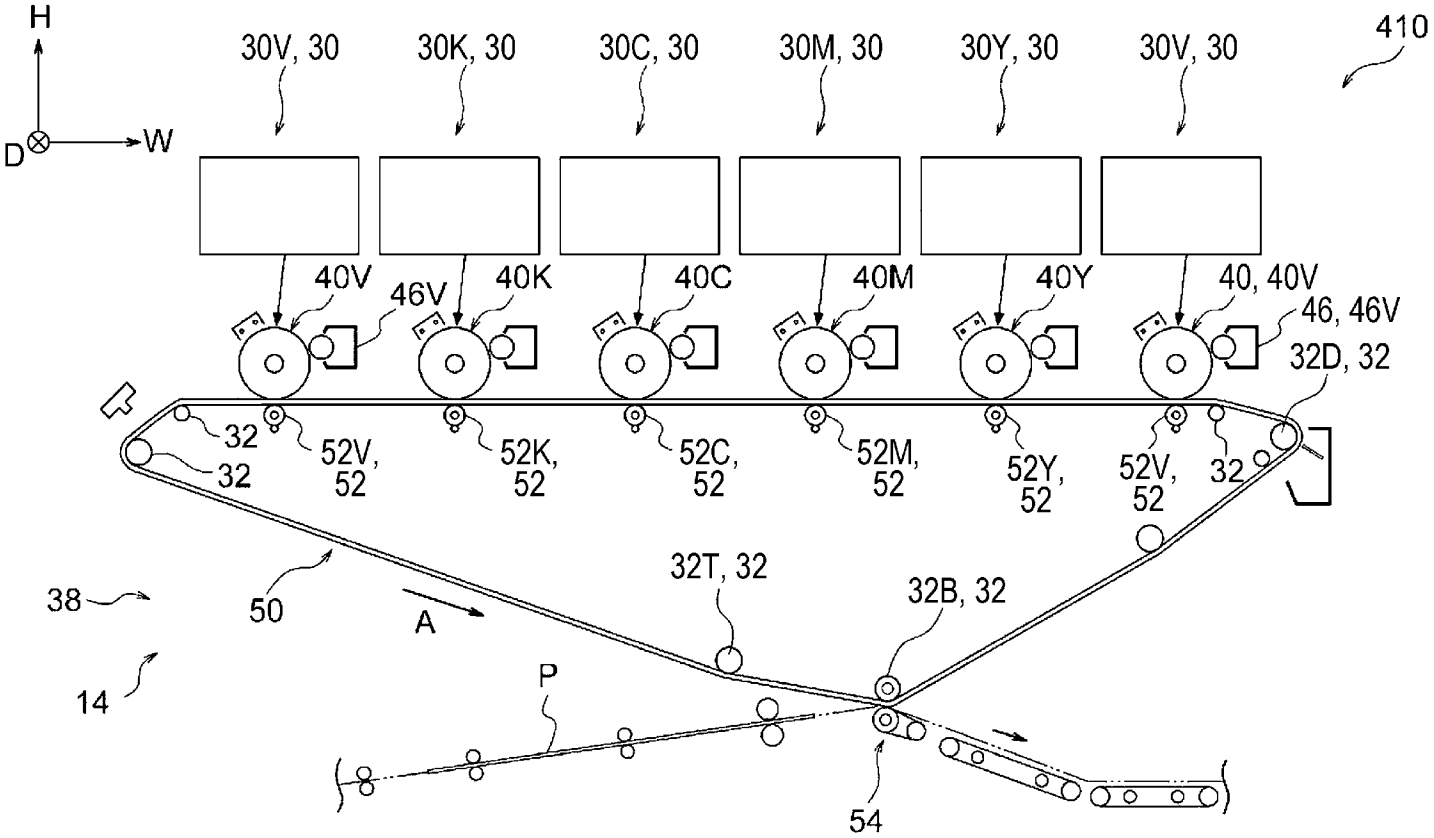
FIG. 20 is a diagram of a structure of a toner layer forming portion and a transfer portion of an image forming apparatus according to a second exemplary embodiment of the present invention.

As illustrated in FIG. 20, an image forming apparatus 410 according to the second exemplary embodiment includes toner layer forming portions 30 for five colors of yellow (Y), magenta (M), cyan (C), black (K), and silver (V). Two toner layer forming portions 30 are provided for silver (V). The toner layer forming portions 30 for silver (V), yellow (Y), magenta (M), cyan (C), black (K), and silver (V) are arranged side by side in the horizontal direction in this order from the upstream side in the rotation direction of the transfer belt 50 (see arrow A in FIG. 20).

Silver Toner 100

A silver toner 100 (hereinafter may be referred to as "V toner") is used in a developing device 46V for the toner layer forming portion 30V.

Figure 22:
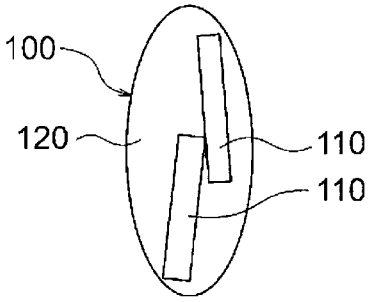
FIG. 22 is a schematic diagram of a silver toner used in the image forming apparatus according to the second exemplary embodiment of the present invention.

As illustrated in FIG. 22, the silver toner 100 (flat toner) contains a flat pigment 110 and a binding resin 120. The flat pigment 110 is formed from aluminum (an example of a metal). A known resin material is used as the binding resin 120, and the binding resin 120 has lower electric conductivity than the flat pigment 110.

Figure 23A:
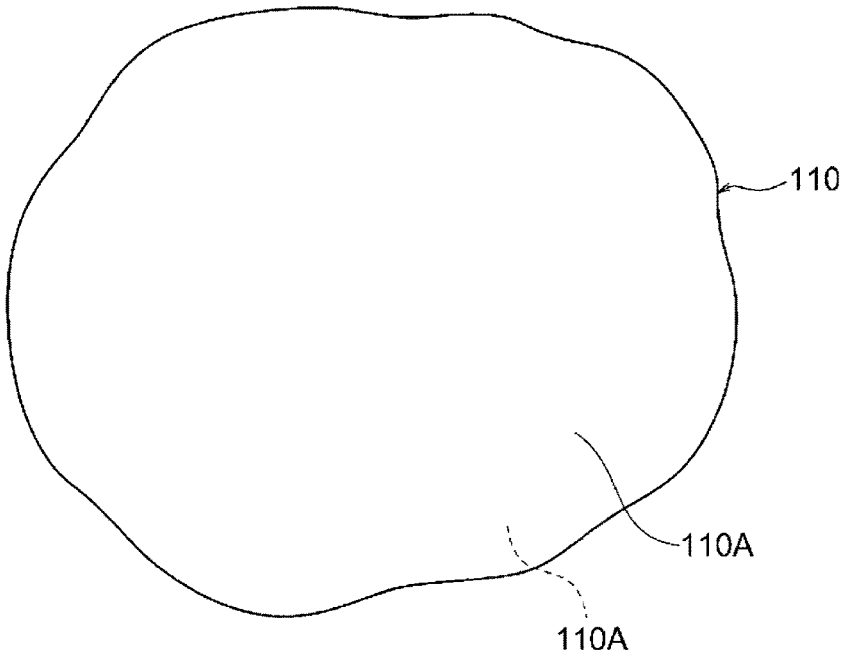
FIGS. 23A and 23B are schematic diagrams of a pigment of a silver toner used in the image forming apparatus according to the second exemplary embodiment of the present invention.
Figure 23B:
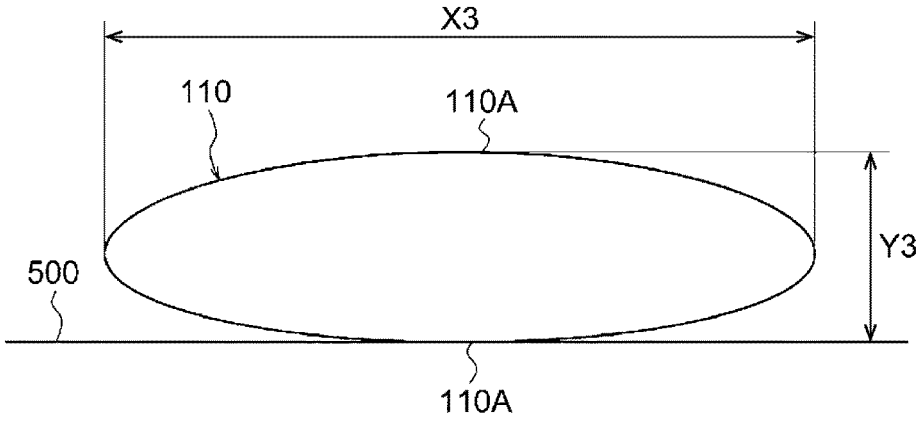

As illustrated in FIG. 23B, when the flat pigment 110 is placed on the flat surface 500 and viewed from the side, the flat pigment 110 has a dimension X3 in the lateral direction that is longer than a dimension Y3 in the vertical direction.

When the flat pigment 110 illustrated in FIG. 23B is viewed from the top, the flat pigment 110 spreads widely as illustrated in FIG. 23A unlike when viewed from the side. The flat pigment 110 has a pair of reflection surfaces 110A facing upward and downward when the flat pigment 110 is placed on the flat surface 500 (see FIG. 23B). As described above, the flat pigment 110 has a flat shape.

Since the flat pigment 110 has a flat shape, the silver toner 100 containing the flat pigment 110 also has a flat shape, following the contour of the flat pigment 110. Thus, when the silver toner 100 is placed on the flat surface 500 and viewed from the side, the silver toner 100 has a dimension A3 in the lateral direction longer than the dimension C3 in the vertical direction, as illustrated in FIG. 24B.

Figure 24A:
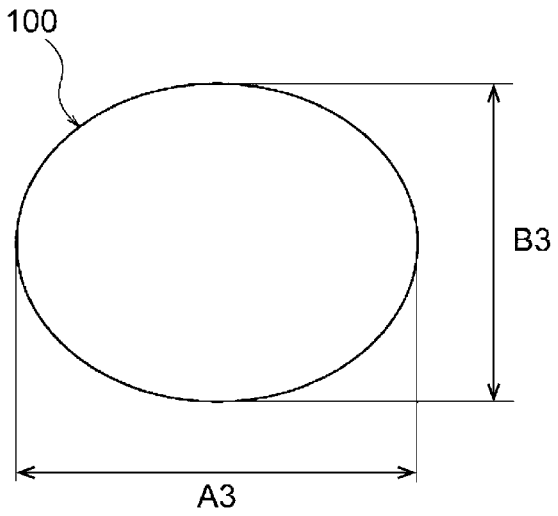
FIGS. 24A and 24B are schematic diagrams of a silver toner used in the image forming apparatus according to the second exemplary embodiment of the present invention.
Figure 24B:
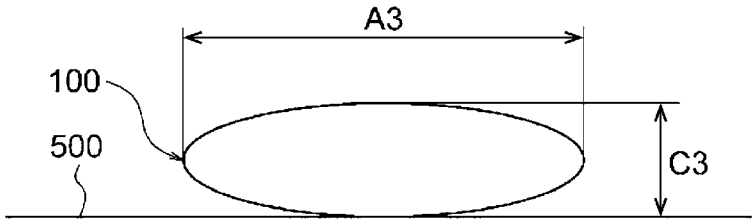

When the silver toner 100 illustrated in FIG. 24B is viewed from the top, the silver toner 100 spreads widely to have a substantially circular shape (substantially elliptic shape) as illustrated in FIG. 24A, unlike when viewed from the side.

Here, the relationship A3≥B3>C3 holds true, where A3 denotes the maximum length (maximum diameter) of the silver toner 100 viewed from the top, B3 denotes an orthogonal length orthogonal to the maximum length A3, and C3 denotes a thickness of the silver toner 100 viewed from the side (dimension in the vertical direction).

In the present exemplary embodiment, an example used as the V toner has a specific gravity of 1.6 g/cm$^3$, a maximum length A3 of 12 μm, an orthogonal length B3 of 12 μm, and a thickness C3 of 2 μm. Thus, the V toner (toner particles) has a mass of $0.24\times10^{-9}$ g.

The maximum length A3, the orthogonal length B3, and the thickness C3 are obtained by observing the toner in an enlarged manner using a color laser microscope "VK-9700" (from KEYENCE CORPORATION) and by calculating the maximum length of the toner flat surface using image processing software.

The silver toner 100 is used as a base coat for the non-white colors on the sheet member P. Specifically, the solid layer (solid image) of the silver toner 100 is formed on the sheet member P as a base coat for the non-white colors to provide glossiness to the toner image.

Described is a case where this structure forms a toner image including a V toner layer for use as a base coat for the Y, M, C, and K color toners 300 to enhance the image glossiness. A device disposed on the downstream side (to the left in FIG. 20) of the non-white color toner layer forming portions 30Y, 30M, 30C, and 30K in the belt rotation direction is used as the toner layer forming portion 30V that forms the V toner layer. A thick paper sheet is used as the sheet member P.

Figure 21:
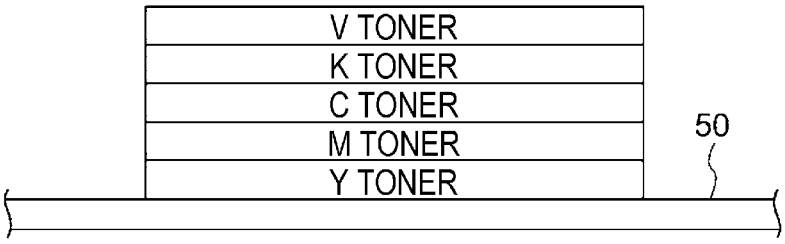
FIG. 21 is a schematic diagram of a toner image obtained by superposing toner layers on a transfer belt using the image forming apparatus according to the second exemplary embodiment of the present invention.

Toner layers formed by the toner layer forming portions 30Y, 30M, 30C, 30K, and 30V are first-transferred to the rotating transfer belt 50 by the first transfer rollers 52 (FIG. 20). As illustrated in FIG. 21, a toner image obtained by superposing the Y toner layer, the M toner layer, the C toner layer, the K toner layer, and the V toner layer in this order is formed (held) on the transfer belt 50. Here, the uppermost one of the toner layers disposed on the transfer belt 50 and constituting the toner images is the V toner layer. The mass of the toner of the uppermost toner layer is $0.24\times10^{-9}$ g, which exceeds the threshold. Thus, the setting portion 58 changes the amount of depression by which the transfer belt 50 depresses the elastic belt 64 to −0.5 mm. In other words, the setting portion 58 sets the pressing force exerted to press the sheet member P against the transfer belt 50 at the second pressing force, which is smaller than the first pressing force.

The transported sheet member P is then transported while being held between the transfer belt 50 and the second transfer portion 54 and while being pressed against the rotating transfer belt 50. Thus, the superposed toner image on the transfer belt 50 is transferred to the sheet member P (see FIG. 20).

As described above, when the uppermost one of the toner layers on the transfer belt 50 is the V toner layer, the mass of the toner of the uppermost toner layer exceeds the threshold. Thus, the image forming apparatus 10 sets the pressing force exerted to press the sheet member P against the transfer belt 50 at the second pressing force, which is smaller than the first pressing force. This structure reduces the amount of the V toner on the transfer belt 50 that scatters in response to the impact exerted when the sheet member P comes into contact with the pressing portion, compared to the structure in which the pressing force exerted to press the sheet member P against the transfer belt 50 is kept constant at the first pressing force.

Other operations are the same as those in the case of the first exemplary embodiment.

Third Embodiment

Examples of a transfer device and an image forming apparatus according to a third exemplary embodiment of the present invention are described with reference to FIGS. 25A and 25B. Portions of the third exemplary embodiment that differ from those of the first exemplary embodiment are mostly described.

Figure 25A:
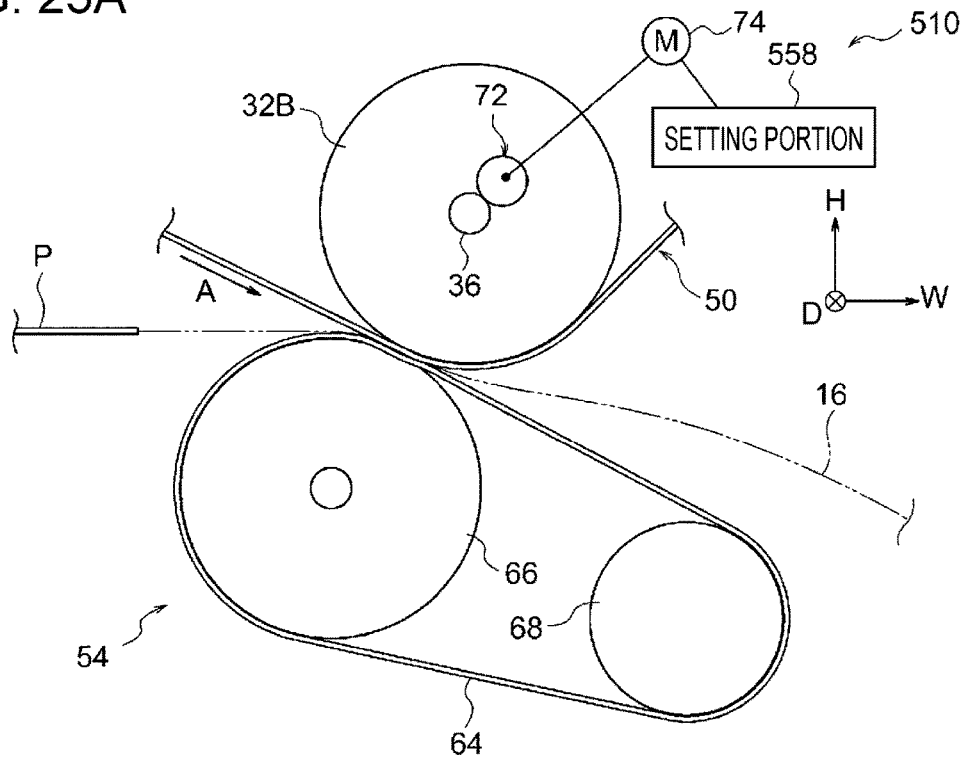
FIGS. 25A and 25B are sectional views of components including a second transfer portion and a transfer belt of an image forming apparatus according to a third exemplary embodiment of the present invention.
Figure 25B:
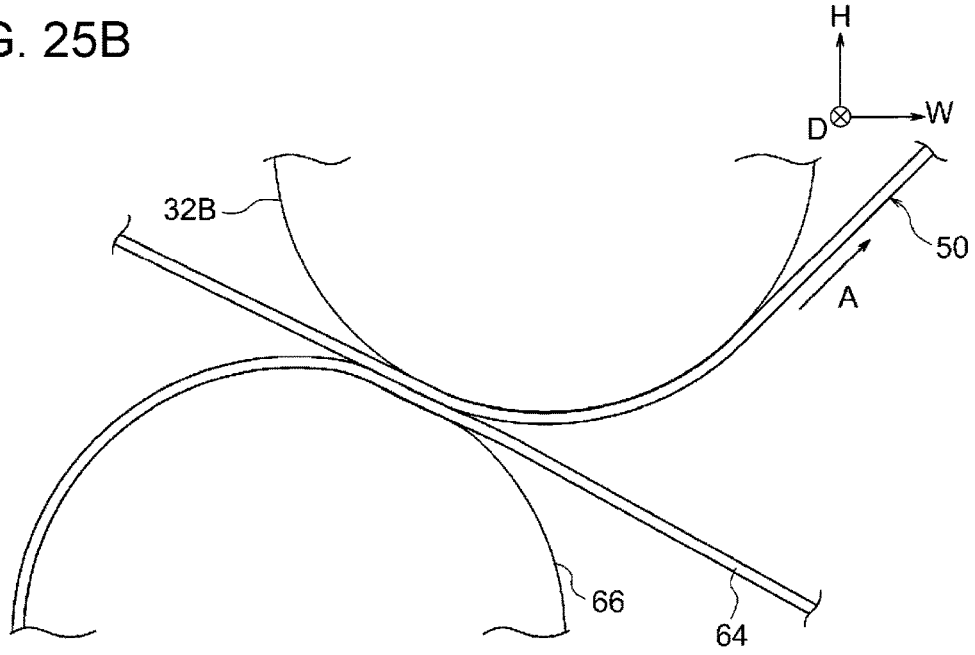

As illustrated in FIGS. 25A and 25B, an image forming apparatus 510 according to the third exemplary embodiment includes a setting portion 558, which drives the motor 74 to rotate the eccentric cams 72. The setting portion 558 changes the amount of depression by which the transfer belt 50 depresses the elastic belt 64 to −0.5 mm, when the mass of the toner (toner particles) of the uppermost toner layer in the toner images on the transfer belt 50 is equal to or exceeds the threshold and the basis weight of the sheet member P is equal to or exceeds the threshold. In other words, the setting portion 558 keeps the pressing force exerted to press the thick paper sheet against the transfer belt 50 at the first pressing force, which is greater than the second pressing force.

Here, in the present exemplary embodiment, the threshold of the basis weight of the sheet member P is 350 g/m$^2$.

In this structure, when an ordinary paper sheet is used as the sheet member P, the setting portion 558 keeps the amount of depression by which the transfer belt 50 depresses the elastic belt 64 at 0.3 mm even when the uppermost one of the toner layers on the transfer belt 50 is the W toner layer. In other words, the setting portion 558 keeps the pressing force exerted to press the ordinary paper sheet against the transfer belt 50 at the first pressing force. As is clear from the table in FIG. 12B, when the ordinary paper sheet is used, the toner image is rated "fair" in the evaluation result even when the amount of depression is 0.3 mm (when the pressing force is set at the first pressing force).

In this manner, when an ordinary paper sheet is used, the amount of depression by which the transfer belt 50 depresses the elastic belt 64 is set at 0.3 mm even when the uppermost one of the toner layers on the transfer belt 50 is the W toner layer. In this case, the amount of electric discharge is reduced compared to the case where the amount of depression is −0.5 mm. This structure reduces the durability reduction of the roller 32B and the roller 66.

Other operations are the same as those of the first exemplary embodiment.

Fourth Exemplary Embodiment

Examples of a transfer device and an image forming apparatus according to a fourth exemplary embodiment of the present invention are described with reference to FIGS. 26A, 26B, and 27. Portions of the fourth exemplary embodiment that differ from those of the first exemplary embodiment are mostly described.

Figure 26A:
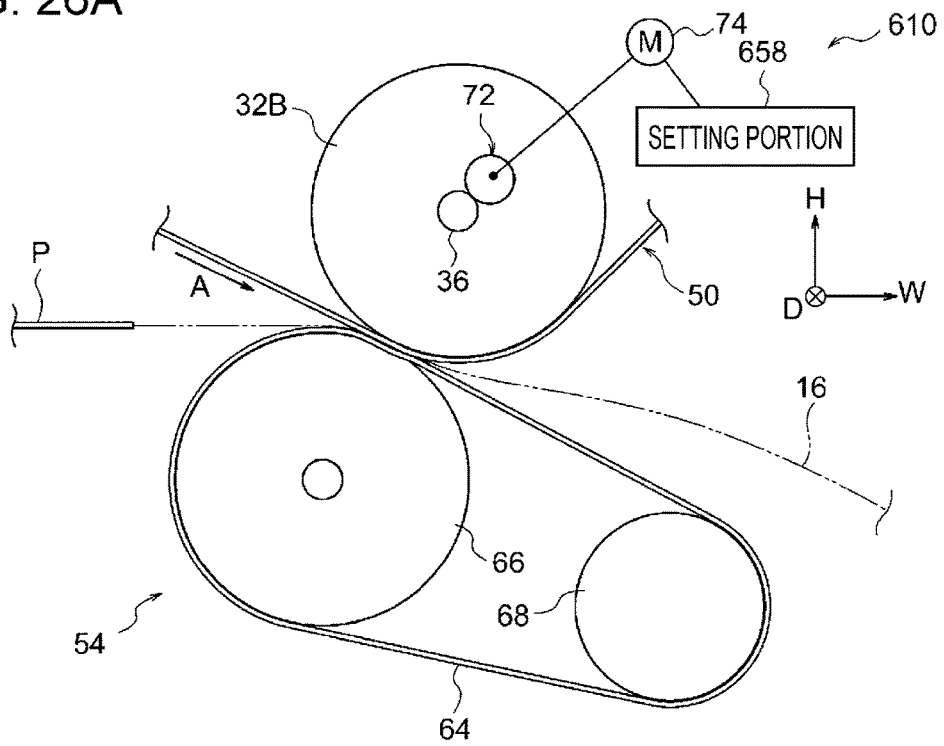
FIGS. 26A and 26B are sectional views of the components including a second transfer portion and a transfer belt of an image forming apparatus according to a fourth exemplary embodiment of the present invention.
Figure 26B:
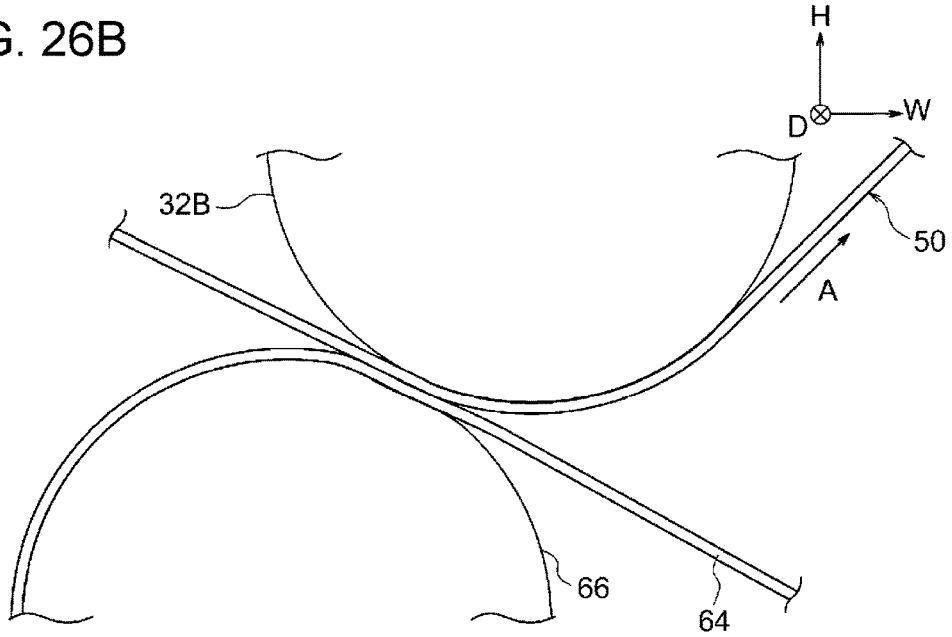
Figure 27:
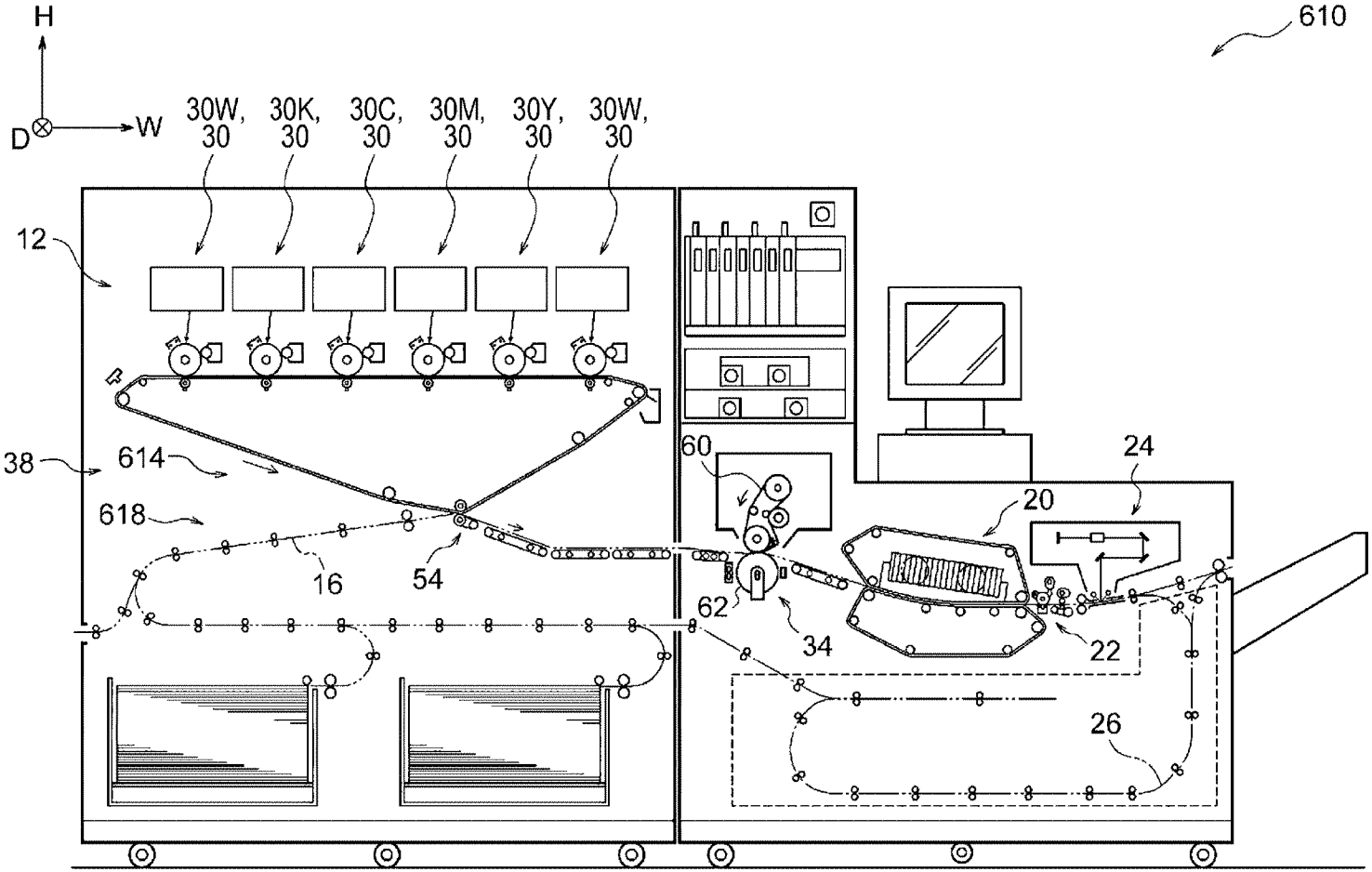
FIG. 27 is a schematic diagram of the structure of the image forming apparatus according to the fourth exemplary embodiment of the present invention.

As illustrated in FIGS. 26A and 26B, an image forming apparatus 610 according to the fourth exemplary embodiment includes a setting portion 658, which drives the motor 74 to rotate the eccentric cams 72. The setting portion 658 sets the pressing force exerted to press the sheet member P against the transfer belt 50 at the second pressing force, which is smaller than the first pressing force, and reduces the transportation speed of the sheet member P, when the mass of the toner of the uppermost toner layer on the transfer belt 50 is equal to or exceeds the threshold.

Specifically, a transport device 618 (see FIG. 27), which is an example of a transporting device that transports the sheet members P, transports the sheet members P at a first transportation speed or a second transportation speed, which is slower than the first transportation speed. The first transportation speed is a speed at which the transport device 18 according to the first exemplary embodiment transports the sheet members P.

The toner layer forming portions 30 and a transfer portion 614, serving as an example of a transfer body, are operable at a first process speed, at which toner images are transferred to the sheet member P transported at the first transportation speed, and a second process speed, at which toner images are transferred to the sheet member P transported at the second transportation speed. The first process speed is a speed at which the transfer portion 14 according to the first exemplary embodiment transfers the toner images to the sheet member P.

In this structure, the setting portion 658 sets the pressing force exerted to press the sheet member P against the transfer belt 50 at the second pressing force, when the mass of the toner of the uppermost toner layer on the transfer belt 50 is equal to or exceeds the threshold. The setting portion 658 causes the transport device 618 to transport the sheet member P at the second transportation speed, and causes the toner layer forming portions 30 and the transfer portion 614 to transfer the toner images to the sheet member P at the second process speed.

In this manner, the transportation speed of the sheet member P is reduced when the image quality is more likely to be reduced by scattering of the W toner. Thus, bending of the leading end portion of the sheet member P as a result of the leading end of the sheet member P coming into contact with the pressing portion is reduced compared to the case where the transportation speed is kept at the constant rate.

Thus, reducing the transportation speed of the sheet member P reduces the quality degradation of the image transferred to the sheet member P compared to the case where the transportation speed is kept at the constant rate.

Other operations are the same as those of the first exemplary embodiment.

Fifth Exemplary Embodiment

An example of an image forming apparatus according to a fifth exemplary embodiment of the present invention is described with reference to FIGS. 28A, 28B, and 29. Portions of the fifth exemplary embodiment that differ from those of the first exemplary embodiment are mostly described.

Figure 28A:
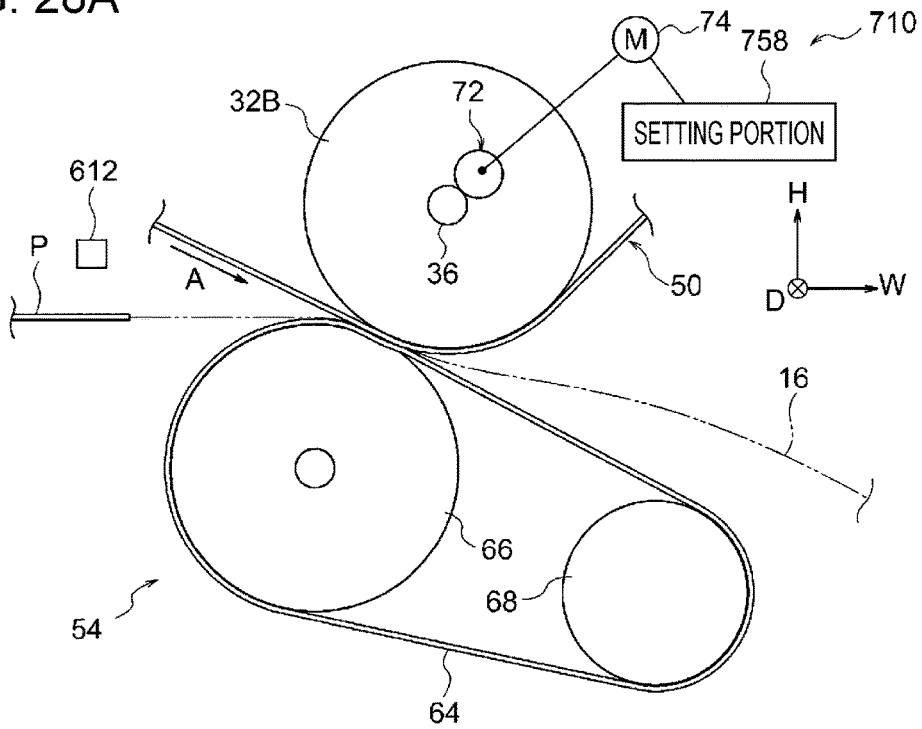
FIGS. 28A and 28B are sectional views of the components including a second transfer portion and a transfer belt of an image forming apparatus according to a fifth exemplary embodiment of the present invention.
Figure 28B:
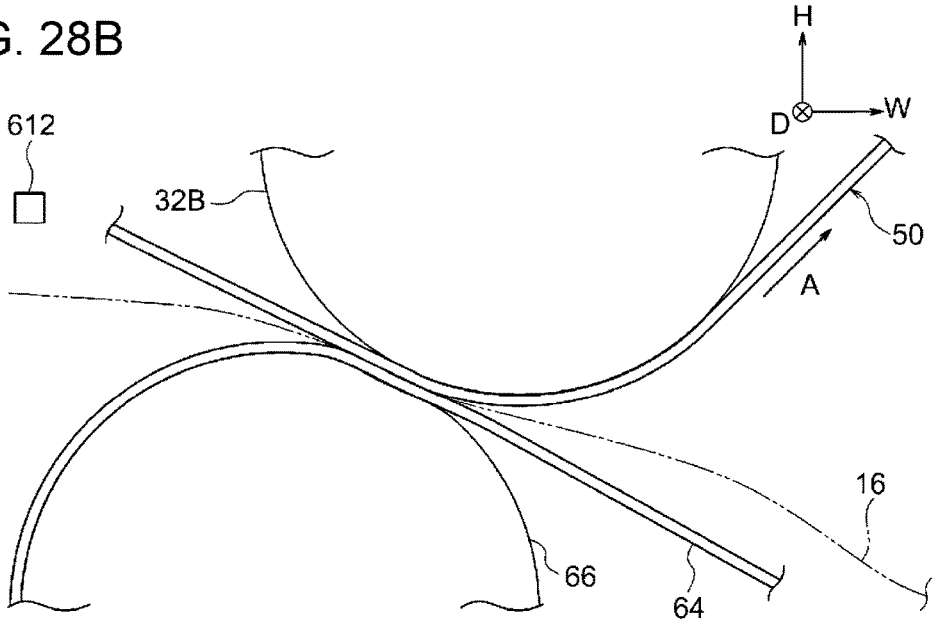
Figure 29:
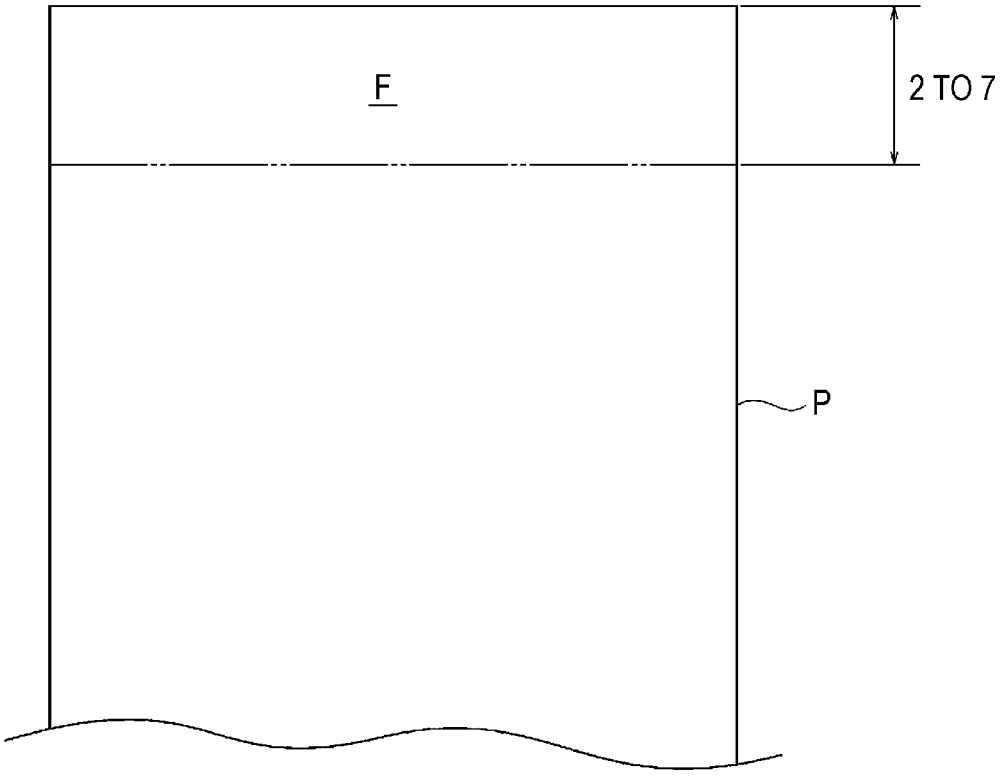
FIG. 29 is a schematic diagram showing the range of a sheet member over which the sheet member is firmly pressed by a pressing portion, the sheet member being used in the image forming apparatus according to the fifth exemplary embodiment of the present invention.

As illustrated in FIGS. 28A and 28B, an image forming apparatus 710 according to a fifth exemplary embodiment includes a setting portion 758, which drives the motor 74 to rotate the eccentric cams 72. The setting portion 758 sets the pressing force exerted to press the sheet member P against the transfer belt 50 at the second pressing force, only while the leading end portion of the sheet member P is passing through the pressing portion, when the mass of the toner of the uppermost toner layer on the transfer belt 50 is equal to or exceeds the threshold.

Specifically, a sensor 612, which detects the leading end of the transported sheet member P, is disposed upstream of the pressing portion formed between the roller 32B and the second transfer portion 54 in the sheet transport direction.

In this structure, the setting portion 758 that has received detection information of the sensor 612 changes the amount of depression by which the transfer belt 50 depresses the elastic belt 64 from 0.3 mm to −0.5 mm only during a predetermined time period. In other words, the setting portion 758 sets the pressing force exerted to press the sheet member P against the transfer belt 50 at the second pressing force, which is smaller than the first pressing force, only during a predetermined time period. Specifically, the amount of depression is changed from 0.3 mm to −0.5 mm only while a portion of the sheet member P within a range of 2 mm to 7 mm from the leading end (in the range F illustrated in FIG. 29) passes through the pressing portion.

Specifically, "the leading end portion of the sheet member P" is limited to the range of the sheet member P 2 mm to 7 mm from the leading end.

In this manner, the setting portion 758 sets a pressing force exerted to press the sheet member P against the transfer belt 50 as the second pressing force, only while the leading end portion is passing through the pressing portion, when the mass of the toner of the uppermost toner layer on the transfer belt 50 is equal to or exceeds the threshold.

Thus, while the transfer belt 50 and the second transfer portion 54 hold the sheet member P therebetween, the reduction of the durability of the roller 32B and the roller 66 is reduced compared to the case where the sheet member P is continuously pressed with the second pressing force.

Although specific exemplary embodiments of the present invention are described in detail, the present invention is not limited to these exemplary embodiment. It is clear to persons having ordinary skill in the art that the present invention may be embodied in various other exemplary embodiments within the scope of the present invention. For example, in the above-described exemplary embodiments, each of the setting portions 58, 558, 658, and 758 sets the pressing force exerted to press the sheet member P against the transfer belt 50 at the second pressing force, when the mass of the toner of the uppermost toner layer on the transfer belt 50 is equal to or exceeds the threshold. Alternatively, each of the setting portions 58, 558, 658, and 758 may set the pressing force exerted to press the sheet member P against the transfer belt 50 at the second pressing force, when the toner of the uppermost toner layer on the transfer belt 50 contains a pigment formed from metal or a metallic oxide.

Specifically, each of the setting portions 58, 558, 658, and 758 may set the pressing force exerted to press the sheet member P against the transfer belt 50 at the second pressing force, when the toner of the uppermost one of the toner layers constituting the toner image and disposed on the transfer belt 50 is a W toner or a V toner. This structure reduces the quality degradation of an image transferred to the sheet member P compared to the structure in which the pressing force exerted to press the sheet member P against the transfer belt 50 is kept constant at the first pressing force.

In the third exemplary embodiment, the setting portion 558 sets the pressing force exerted to press the sheet member P against the transfer belt 50 at the second pressing force, when the mass of the toner of the uppermost toner layer on the transfer belt 50 is equal to or exceeds the threshold and the basis weight of the sheet member P is equal to or exceeds the threshold. Instead, the setting portion 558 may set the pressing force exerted to press the sheet member P against the transfer belt 50 at the second pressing force, when the toner of the uppermost toner layer on the transfer belt 50 contains a pigment formed from a metal or a metallic oxide and the basis weight of the sheet member P is equal to or exceeds the threshold.

In the fourth exemplary embodiment, the setting portion 658 sets the pressing force exerted to press the sheet member P against the transfer belt 50 at the second pressing force, and reduces the transportation speed of the sheet member P, when the mass of the toner of the uppermost toner layer on the transfer belt 50 is equal to or exceeds the threshold. Instead, the setting portion 658 may set the pressing force exerted to press the sheet member P against the transfer belt 50 at the second pressing force, and reduce the transportation speed of the sheet member P, when the toner of the uppermost toner layer on the transfer belt 50 contains a pigment formed from a metal or a metallic oxide.

In the fifth exemplary embodiment, the setting portion 758 sets the pressing force exerted to press the sheet member P against the transfer belt 50 at the second pressing force only while the leading end portion of the sheet member P is passing through the pressing portion, when the mass of the toner of the uppermost toner layer on the transfer belt 50 is equal to or exceeds the threshold. Instead, the setting portion 758 may set the pressing force exerted to press the sheet member P against the transfer belt 50 at the second pressing force, only while the leading end portion of the sheet member P is passing through the pressing portion, when the toner of the uppermost toner layer on the transfer belt 50 contains a pigment formed from a metal or a metallic oxide.

In the above-described exemplary embodiment, the volumetric average particle diameter is used to calculate the mass of the white toner 200 or the color toners 300. Instead, the particle diameter averaged by the number of particles may be used to calculate the mass. The particle diameter averaged by the number of particles may be measured by a charge spectrometer (E-Spart ANALYZER) from HOSOKAWA MICRON CORPORATION. This is a measuring device that detects the movement of particles in the aerial vibration field in the electric field by a laser Doppler method and concurrently measures the amount of electric charge and the particle diameter of individual particles from the data. The data of 3000 toner particles are input to this device and the average of the individual particle diameter data is the particle diameter averaged by the number of particles.

In each of the above-described exemplary embodiment, the present application is described using a tandem image forming apparatus 10 that develops a latent image on a single image carrier 40 with a single developing device 46. Instead, the image forming apparatus 10 may be a revolver (5 to 6 cycle) image forming apparatus that develops a latent image on a single image carrier with multiple developing devices.

The foregoing description of the exemplary embodiments of the present invention has been provided for the purposes of illustration and description. It is not intended to be exhaustive or to limit the invention to the precise forms disclosed. Obviously, many modifications and variations will be apparent to practitioners skilled in the art. The exemplary embodiments were chosen and described in order to best explain the principles of the invention and its practical applications, thereby enabling others skilled in the art to understand the invention for various exemplary embodiments and with the various modifications as are suited to the particular use contemplated. It is intended that the scope of the invention be defined by the following claims and their equivalents.

What is claimed is:

1. A transfer device, comprising:

a holding body that holds a toner image formed of multiple toner layers;

a transfer body that presses a recording medium against the holding body with a first pressing force or a second pressing force, which is smaller than the first pressing force, to transfer the toner image to the recording medium while transporting the recording medium between the transfer body and the holding body; and a motor controller that sets a pressing force exerted on the recording medium at the second pressing force when a mass of a toner of an uppermost layer of the toner layers disposed on the holding body is equal to or exceeds a threshold.

2. The transfer device according to claim 1, wherein the transfer body holds and transports the recording medium between the transfer body and the holding body from a leading end portion of the recording medium, and wherein, under conditions where the motor controller sets a pressing force exerted on the recording medium at the second pressing force, the motor controller sets a pressing force exerted to press the recording medium against the holding body at the second pressing force only while the holding body is holding the leading end portion of the recording medium.

3. The transfer device according to claim 1, wherein the motor controller sets a pressing force exerted on the recording medium at the first pressing force under conditions different from conditions where the motor controller sets a pressing force exerted on the recording medium at the second pressing force.

4. An image forming apparatus, comprising:

the transfer device according to claim 1; and an image forming unit that forms a toner image held on the holding body of the transfer device.

5. The image forming apparatus according to claim 4, further comprising:

a transporting device that transports a recording medium to which a toner image is transferred with a first transportation speed or a second transportation speed, which is slower than the first transportation speed, wherein, under conditions where the motor controller sets a pressing force exerted on the recording medium at the second pressing force, the motor controller sets a speed at which the transporting device transports the recording medium at the second transportation speed.

6. A transfer device, comprising:

a holding body that holds a toner image formed of multiple toner layers;

a transfer body that presses a recording medium against the holding body with a first pressing force or a second pressing force, which is smaller than the first pressing force, to transfer the toner image to the recording medium while transporting the recording medium between the transfer body and the holding body; and a motor controller that sets a pressing force exerted on the recording medium at the second pressing force when a toner of an uppermost layer of the toner layers disposed on the holding body contains a pigment formed from a metal or a metallic oxide.

7. A transfer device, comprising:

a holding body that holds a toner image formed of multiple toner layers;

a transfer body that presses a recording medium against the holding body with a first pressing force or a second pressing force, which is smaller than the first pressing force, to transfer the toner image to the recording medium while transporting the recording medium between the transfer body and the holding body; and a motor controller that sets a pressing force exerted on the recording medium at the second pressing force when a mass of a toner of an uppermost layer of the toner layers disposed on the holding body is equal to or exceeds a threshold and a basis weight of the recording medium is equal to or exceeds a threshold.

* * * * *